US008616541B2

(12) United States Patent
Hayashi

(10) Patent No.: US 8,616,541 B2
(45) Date of Patent: Dec. 31, 2013

(54) SHEET PROCESSING APPARATUS AND IMAGE FORMING APPARATUS

(75) Inventor: Kenichi Hayashi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 667 days.

(21) Appl. No.: 12/499,428

(22) Filed: Jul. 8, 2009

(65) Prior Publication Data

US 2010/0007071 A1 Jan. 14, 2010

(30) Foreign Application Priority Data

Jul. 11, 2008 (JP) ..... 2008-180986
Jun. 22, 2009 (JP) ..... 2009-147448

(51) Int. Cl.
*B41F 13/56* (2006.01)
*G03G 15/00* (2006.01)

(52) U.S. Cl.
USPC ..... 270/21.1; 399/407; 399/408

(58) Field of Classification Search
USPC ..... 270/21.1; 399/407, 408
See application file for complete search history.

(56) References Cited

U.S. PATENT DOCUMENTS

| | | | | |
|---|---|---|---|---|
| 6,044,246 | A * | 3/2000 | Tashiro et al. | 399/410 |
| 6,692,208 | B1 | 2/2004 | Watkiss et al. | |
| 2008/0174825 | A1* | 7/2008 | Hatakeyama | 358/1.18 |
| 2009/0051098 | A1 | 2/2009 | Toda et al. | |

FOREIGN PATENT DOCUMENTS

| | | | |
|---|---|---|---|
| EP | 1772285 | A2 | 4/2007 |
| JP | 2000-198613 | A | 7/2000 |
| JP | 2004-345863A | A | 12/2004 |
| JP | 2006-247836A | A | 9/2006 |
| WO | 2009/072294 | A1 | 6/2009 |

* cited by examiner

*Primary Examiner* — Ren Yan
(74) *Attorney, Agent, or Firm* — Canon USA Inc. IP Division

(57) ABSTRACT

A sheet processing apparatus that can process a folded sheet bundle, comprising: deforming processing means configured to perform deforming processing by deforming a folded spinal portion of the folded sheet bundle to form a substantially flat portion along the folded spinal portion; and cutting means configured to cut an edge portion, opposite to the folded spinal portion, of the folded sheet bundle, wherein the distance from the folded spinal portion of a folded sheet bundle to a position to be cut by the cutting means is shorter for a folded sheet bundle A having a particular thickness and having been subjected to the deforming processing than the distance from the folded spinal portion of the folded sheet bundle to a position to be cut by the cutting means for a folded sheet bundle B not subjected to the deforming processing but having the same thickness as folded sheet bundle A.

12 Claims, 21 Drawing Sheets

SHEET PROCESSING APPARATUS AND IMAGE FORMING APPARATUS

BACKGROUND OF THE INVENTION

1. Field of the Invention

The present invention relates to a sheet processing apparatus and an image forming apparatus, and more particularly relates to an apparatus that folds a sheet bundle and performs bookbinding processing.

2. Description of the Related Art

There is a conventional image forming apparatus (e.g., a copying machine, a laser beam printer, etc.) equipped with a sheet processing apparatus that can appropriately fold respective sheets discharged from the image forming apparatus, or stitch the sheets along their center lines and then fold the stitched sheets for saddle stitch bookbinding.

In the saddle stitch bookbinding processing, if the number of sheets constituting a sheet bundle is large (e.g., 20 or more) and the bundle of sheets is bent for bookbinding, a folded spinal portion of a finished product may have a curvature or bow. A folded sheet bundle finished in this manner may still open somewhat even after the sheet bundle is firmly pressed and folded giving it an unattractive appearance. Such a curvature or bow in the folded spinal portion also makes it more difficult to stack a number of such folded sheet bundles due to the variation in thickness.

To improve the appearance and flatness of a folded sheet bundle, a sheet processing apparatus discussed in U.S. Pat. No. 6,692,208 includes a pressing roller that can travel along a folded spinal portion of the folded sheet bundle to deform or squash a curvature of the folded spinal portion.

FIGS. 18A to 18C illustrate an example configuration of a conventional sheet processing apparatus. When the sheet processing apparatus performs processing for deforming a folded spinal portion of a folded sheet bundle, a pair of belt conveying means 1106 and 1107 conveys a folded sheet bundle S until the folded spinal portion collides against a positioning means 1105 as illustrated in FIG. 18A. After the folded spinal portion abuts against the positioning means 1105, the belt conveying means 1106 and 1107 continuously rotate a predetermined amount to further convey the folded sheet bundle S while causing slip on their surfaces. This is effective to correct a skew of the folded sheet bundle S and accurately adjust the position of the folded sheet bundle S.

Next, as illustrated in FIG. 18B, the folded sheet bundle S is held between a pair of grip means 1102 and 1103 with its folded spinal portion protruding. Namely, the grip means 1102 and 1103 cooperatively fix the folded sheet bundle S at a position adjacent to the folded spinal portion. The positioning means 1105 moves to a retreat position. Then, as illustrated in FIGS. 19A and 19B, a pressing roller 1104 travels in a direction indicated by an arrow while applying pressure, against or opposed to the conveying direction, to the folded spinal portion of the curved sheet bundle S that protrudes from the grip means 1102 and 1103.

Thus, the folded spinal portion of the curved sheet bundle S can be deformed to create a substantially flat surface along the folded spinal portion, the substantially flat surface preferably being substantially perpendicular to the front and rear cover of the sheet bundle. Then, as illustrated in FIG. 18C, the belt conveying means 1106 and 1107 convey and discharge the deformed folded sheet bundle S to a sheet discharge tray 1108.

As discussed in Japanese Patent Application Laid-Open No. 2000-198613, there is a conventional cutting apparatus (i.e., a trimmer) that performs processing for cutting a sheet bundle along one end (i.e., opened end) thereof after the sheet bundle is subjected to saddle stitch bookbinding. A sheet bundle finished by the saddle stitch bookbinding has a central sheet that protrudes at its opened end compared to other sheets (the protrusion being greatest with respect to a sheet adjacent to the front or rear cover) if the thickness of the sheet bundle is large at a bending portion of the folded sheet bundle. Therefore, the opened end portion of the sheet bundle takes a convex shape. A product having a good appearance can be obtained by cutting the convex shape into a flat shape.

FIG. 20 illustrates a conventional cutting apparatus (i.e., a sheet processing apparatus) that includes an upper cutting blade 2101 and a lower cutting blade 2102 that cooperatively cut a folded sheet bundle S that is finished by the saddle stitch bookbinding processing. To cut the folded sheet bundle S, a conveyance belt 2111 conveys the folded sheet bundle S to a position between the upper and lower cutting blades 2101 and 2102 and stops rotating if a folded spinal portion of the folded sheet bundle S collides against a stopper 2127. In ordinary processing for cutting the opened end of a folded sheet bundle in a state where the folded spinal portion of the folded sheet bundle abuts against the positioning means 1105, a cutting position is spaced a predetermined amount from the folded spinal portion. The position of the stopper 2127 is changeable in the conveyance direction according to the size of the folded sheet bundle S and a determined cutting amount.

A gripping unit 2136 firmly holds the folded sheet bundle S during a cutting operation in a state where the folded sheet bundle S abuts against the stopper 2127. Then, the upper cutting blade 2101 moves downward and, after it reaches the lower cutting blade 2102, cuts the folded sheet bundle S. The folded sheet bundle S, being cut in this manner, is conveyed to a bundle storage (not illustrated). The cutting scrap generated in this cutting operation falls into a scrap box 2108 positioned below the cutting blades 2101 and 2102.

In FIG. 20, a swing guide 2114 can guide the folded sheet bundle S from the conveyance belt 2111 to the lower cutting blade 2102. When the folded sheet bundle S is cut, the swing guide 2114 moves (i.e., rotates) downward to let the scrap fall into the scrap box 2108. When the cutting processing is completed, the swing guide 2114 moves upward to guide the next folded sheet bundle.

However, to improve the appearance of both the folded spinal portion and the opened end portion, it is usual to perform the above-described two edge portion processing. As example processing applied to edge portions of a sheet, the above-described deforming processing may be applied to a folded spinal portion and the arranging processing (i.e., cutting processing) may be applied to an opened end portion to improve the quality of the processed folded sheet bundle. In this case, it is desired to cut the opened end of the sheet bundle after completing the deforming processing. More specifically, after finishing the deforming processing applied to the folded spinal portion of the folded sheet bundle S, the deformed folded spinal portion of the sheet bundle S collides against the stopper held at a position determined according to the size or thickness of the sheet bundle S. Then, the cutting processing is performed on the sheet bundle S being thus positioned.

However, the applicant has identified that if a conventional sheet processing apparatus or a conventional image forming apparatus performs deforming processing on a folded spinal portion and arranging processing on an opened end portion, a folded sheet bundle S1 having been subjected to the deforming processing becomes shorter in length, by a deforming amount of the folded spinal portion, in the sheet conveyance direction (i.e., the length from the folded spinal portion to the opened end) as illustrated in FIG. 21.

Therefore, if two folded sheet bundles S1 and S2 to be cut at their opened ends have the same thickness, the length of the folded sheet bundle S1 having been subjected to the deforming processing in the sheet conveyance direction is shorter than the length of the folded sheet bundle S2 not subjected to the deforming processing in sheet conveyance direction by an amount equivalent to a deforming amount L. For example, as illustrated in FIG. 21, "A" represents a length from a folded spinal portion of respective folded sheet bundles S1 and S2 to the upper cutting blade 2101, and "C" represents an edge portion cutting amount (i.e., cutting length) of the folded sheet bundles S1 and S2 having been positioned.

In this case, the folded sheet bundle S1 having been subjected to the deforming processing is shorter in actual cutting length than the folded sheet bundle S2 not subjected to the deforming processing by an amount equivalent to the deforming amount L. When an image forming apparatus performs image formation on each sheet, a distance from one edge portion to an image writing position on the sheet is constant in the sheet conveyance direction of a folded sheet bundle. Therefore, if the cutting processing is performed on a folded sheet bundle including a plurality of sheets on which images are formed, the cutting position at the opened end portion needs to be separated from an image forming portion.

In general, to improve the quality of a folded sheet bundle, it is desired to cut a curved shape of the opened end portion into a flat shape. To this end, as a condition for the cutting processing applied to the folded sheet bundle S2 not subjected to the deforming processing, the above-described image formation may be taken into consideration to determine the distance from the folded spinal portion of the folded sheet bundle S2 to the cutting position. However, if the distance between the folded spinal portion and the cutting position determined for the folded sheet bundle S2 is directly used in the cutting processing for the folded sheet bundle S1 having been subjected to the deforming processing, the cutting position may shift into a region corresponding to the curved shape of the opened end portion, as the length in the sheet conveyance direction is shortened by the deforming amount L. As a result, the opened end portion of the folded sheet bundle S1 may not be cut into a flat shape.

SUMMARY OF THE INVENTION

Exemplary embodiments of the present invention are directed to a sheet processing apparatus and an image forming apparatus that can perform cutting processing according to a determined edge portion cutting amount irrespective of the presence of a deforming or squashing processing setting.

According to an aspect of the present invention, a sheet processing apparatus that can process a folded sheet bundle, includes a deforming unit configured to perform deforming processing by deforming a folded spinal portion of the folded sheet bundle, and a cutting unit configured to cut an edge portion, opposite to the folded spinal portion, of the folded sheet bundle, wherein the sheet processing apparatus is configured such that the distance from the folded spinal portion of a folded sheet bundle to a position to be cut by the cutting unit is shorter for a folded sheet bundle A having a particular thickness and having been subjected to the deforming processing than the distance from the folded spinal portion of the folded sheet bundle to a position to be cut by the cutting unit for a folded sheet bundle B not subjected to the deforming processing but having the same thickness as folded sheet bundle A.

An exemplary embodiment of the present invention can perform cutting processing according to a predetermined edge portion cutting amount, irrespective of the presence of a deforming processing setting, because when a folded sheet bundle not subjected to the deforming or squashing processing is cut, the length of a bookbinding product obtained by the cutting processing is set to be longer than the length of a bookbinding product obtained when a sheet bundle having been subjected to the deforming processing is cut.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments and features of the invention and, together with the description, serve to explain at least some of the principles of the invention.

DETAILED DESCRIPTION OF THE EMBODIMENTS

Figure 1:
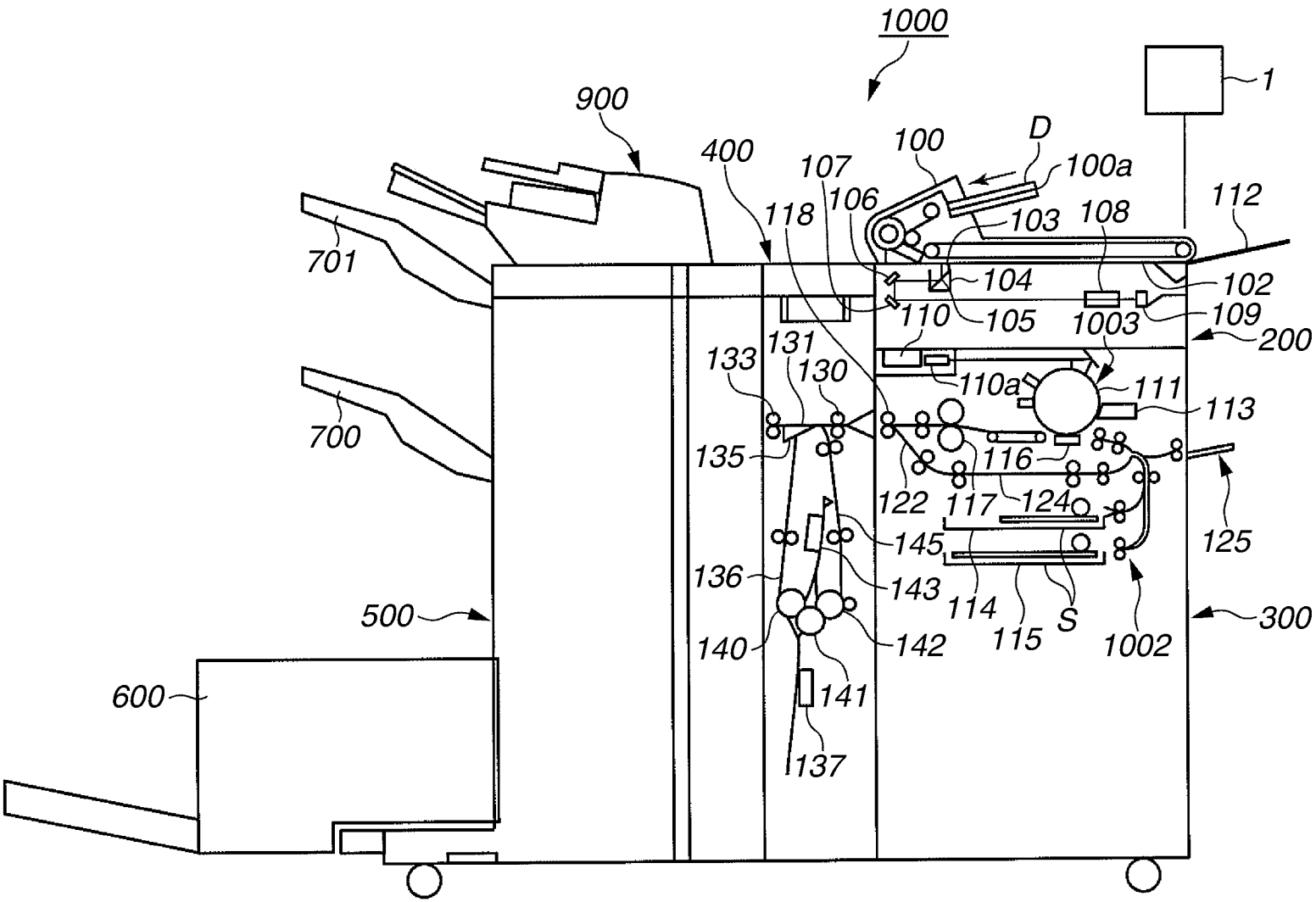
FIG. 1 is a cross-sectional view of a copying machine that can serve as an example of an image forming apparatus including a sheet processing apparatus according to an exemplary embodiment of the present invention.

The following description of exemplary embodiments is illustrative in nature and is in no way intended to limit the invention, its application, or uses. It is noted that throughout the specification, similar reference numerals and letters refer to similar items in the following figures, and thus once an item is described in one figure, it may not be discussed for following figures. Various exemplary embodiments, features, and aspects of the invention will be described in detail below with reference to the drawings.

FIG. 1 is a cross-sectional view of a copying machine that can serve as an example of an image forming apparatus including a sheet processing apparatus according to an exemplary embodiment of the present invention.

In FIG. 1, a copying machine 1000 includes a copying machine body 300 and a scanner 200 disposed on an upper surface of the copying machine body 300.

The scanner 200, which is configured to read a document, includes a document feeding unit 100, a scanner unit 104, a lens 108, and an image sensor 109. When the scanner 200 reads a document D, a user sets the document D on a tray 100*a* of the document feeding unit 100. For example, the document D may be placed on the tray 100*a* in a face-up state where an image-formed surface of the document D faces upward.

Next, the document feeding unit 100 successively conveys sheets of the document D being set in this manner to the left (i.e., an arrow direction in FIG. 1) one after another from its head page. The document feeding unit 100 conveys each sheet to a platen glass 102 via a curved path and further conveys the sheet from left to right on the platen glass 102, and finally discharges the sheet to a sheet discharge tray 112.

In this case, if the document feeding unit 100 performs a feeding-reading operation for document reading, the scanner unit 104 is stationarily held at a predetermined position to read the document D that travels from left to right above the scanner unit 104. In the reading processing, the document D is irradiated with light emitted from a lamp 103 of the scanner unit 104 while the document D moves on the platen glass 102. Reflection light from the document D is guided to the image sensor 109 by mirrors 105, 106, and 107 and the lens 108. The image sensor 109 reads the document D. Then, predetermined image processing is performed on the image data read by the image sensor 109. The processed image data is then sent to the exposure control unit 110.

If the document feeding unit 100 performs a fixed-reading operation for document reading, the document feeding unit 100 temporarily stops the conveyed document D on the platen glass 102 while the scanner unit 104 moves from left to right to perform document reading processing. If a user does not use the document feeding unit 100, the user can lift the document feeding unit 100 and manually set the document on the platen glass 102.

The copying machine body 300 includes a sheet feeding unit 1002 configured to feed a sheet S from a cassette 114 or 115 and an image forming unit 1003 configured to form an image of the sheet S fed by the sheet feeding unit 1002.

The image forming unit 1003 includes a photosensitive drum 111, a development unit 113, and a transfer charging device 116. A latent image can be formed on the photosensitive drum 111 when the photosensitive drum 111 is irradiated with a laser beam emitted from the exposure control unit 110. The latent image can be visualized as a toner image by the development unit 113. A fixing unit 117 and a discharge roller pair 118 are disposed on a downstream side of the image forming unit 1003 in the conveyance direction.

The copying machine body 300 can perform an image forming operation with the above-described configuration.

The image data of the document D read by the image sensor 109 as described above, when the scanner 200 performs a feeding-reading or fixed-reading operation, is subjected to predetermined image processing and sent to the exposure control unit 110. The exposure control unit 110 outputs a laser beam corresponding to the received image signal. In synchronization with a scanning operation of a polygonal mirror 110*a*, the photosensitive drum 111 is irradiated with the laser beam emitted from exposure control unit 110. An electrostatic latent image can be formed on the photosensitive drum 111 according to the scanned laser beam. The development unit 113 can develop the electrostatic latent image formed on the photosensitive drum 111 and visualize it as a toner image.

The sheet S can be conveyed from any one of the cassettes 114 and 115, a manual sheet feeding unit 125, and a two-sided conveyance path 124 to a transfer unit, which can be constituted by the photosensitive drum 111 and the transfer charging device 116. The transfer unit can transfer the toner image visualized on the photosensitive drum 111 to the sheet S. The fixing unit 117 performs fixing processing on the sheet S supplied from the transfer unit.

A switching means (not illustrated) guides the sheet S having passed through the fixing unit 117 to a path 122. In the path 122, the sheet S causes a switchback motion after a rear end of the sheet S has passed through the switching means in the conveyance direction. Then, the switching means conveys the sheet S to the discharge roller pair 118. The discharge roller pair 118 discharges the sheet S out of the copying machine body 300. In this case, the sheet S discharged from the copying machine body 300 is in a face-down state where a toner image formed surface of the sheet S faces downward.

With the above-described reverse discharge operation, the sheet S can be discharged in a face-down state. Thus, when the image forming processing is performed successively from a head page of a document, for example, when the image forming processing is performed on image data supplied from a computer, the processed sheets with images formed thereon can be set according to the page order. If the sheet S to be subjected to the image forming processing is a hard sheet (e.g., an OHP sheet conveyed from the manual sheet feeding unit 125), the sheet S is not guided to the path 122 and the roller pair 118 discharges the sheet S from the copying machine body 300 in a face-up state where the toner image formed surface of the sheet S faces upward.

In a case where the copying machine performs image forming processing on both surfaces of the sheet S, the sheet S is directly guided from the fixing unit 117 to the roller pair 118. The sheet S causes a switchback motion immediately after the rear end of the sheet S has passed through the switching means in the conveyance direction. Then, the sheet S is guided to the two-sided conveyance path 124 by the switching means.

The copying machine body 300 is associated with a folding processing unit 400. The folding processing unit 400 can fold sheets having been subjected to image forming processing and discharged from the copying machine body 300. The folding processing unit 400 is connected to a finisher 500 that has the capability of stitching sheets or performing bookbinding processing. The finisher 500, a staple unit 500A, a saddle stitch binding unit 800 (i.e., a bookbinding unit), and a saddle stitch booklet processing unit 600 can operate as the sheet processing apparatus according to the present exemplary embodiment.

The folding processing unit 400 includes a conveyance path 131 that can receive a sheet discharged from the copying machine body 300 and guide the sheet to the finisher 500. A conveyance roller pair 130 and a discharge roller pair 133 are provided in the conveyance path 131. A switching means 135 is provided in the vicinity of the discharge roller pair 133. The switching means 135 can guide a sheet conveyed by the conveyance roller pair 130 to a folding path 136 or to the finisher 500.

When the folding processing unit 400 performs folding processing on sheets, the folding processing unit 400 switches the switching means 135 to guide a sheet to the folding path 136. The sheet guided to the folding path 136 collides with a stopper 137 at a front end thereof in the conveyance direction. The sheet starts deforming into a loop shape in a state where the front end of the sheet is stopped by the stopper 137. The sheet deformed into a loop shape is then folded by a pair of folding rollers 140 and 141 to form a folded portion.

Next, the folded portion collides with an upper stopper 143 to form another loop. The loop portion is then folded by another pair of folding rollers 141 and 142. As a result, the sheet can be folded into a Z shape. The sheet folded into the Z shape is sent via the conveyance path 145 to the conveyance path 131. The discharge roller pair 133 discharges the Z-folded sheet to the finisher 500, which is located on the downstream side in the conveyance direction.

The folding processing unit 400 can selectively perform the folding processing. If no folding processing is necessary, the folding processing unit 400 switches the switching means 135 to directly guide a sheet discharged from the copying machine body 300 to the finisher 500 via the conveyance path 131.

Figure 2:
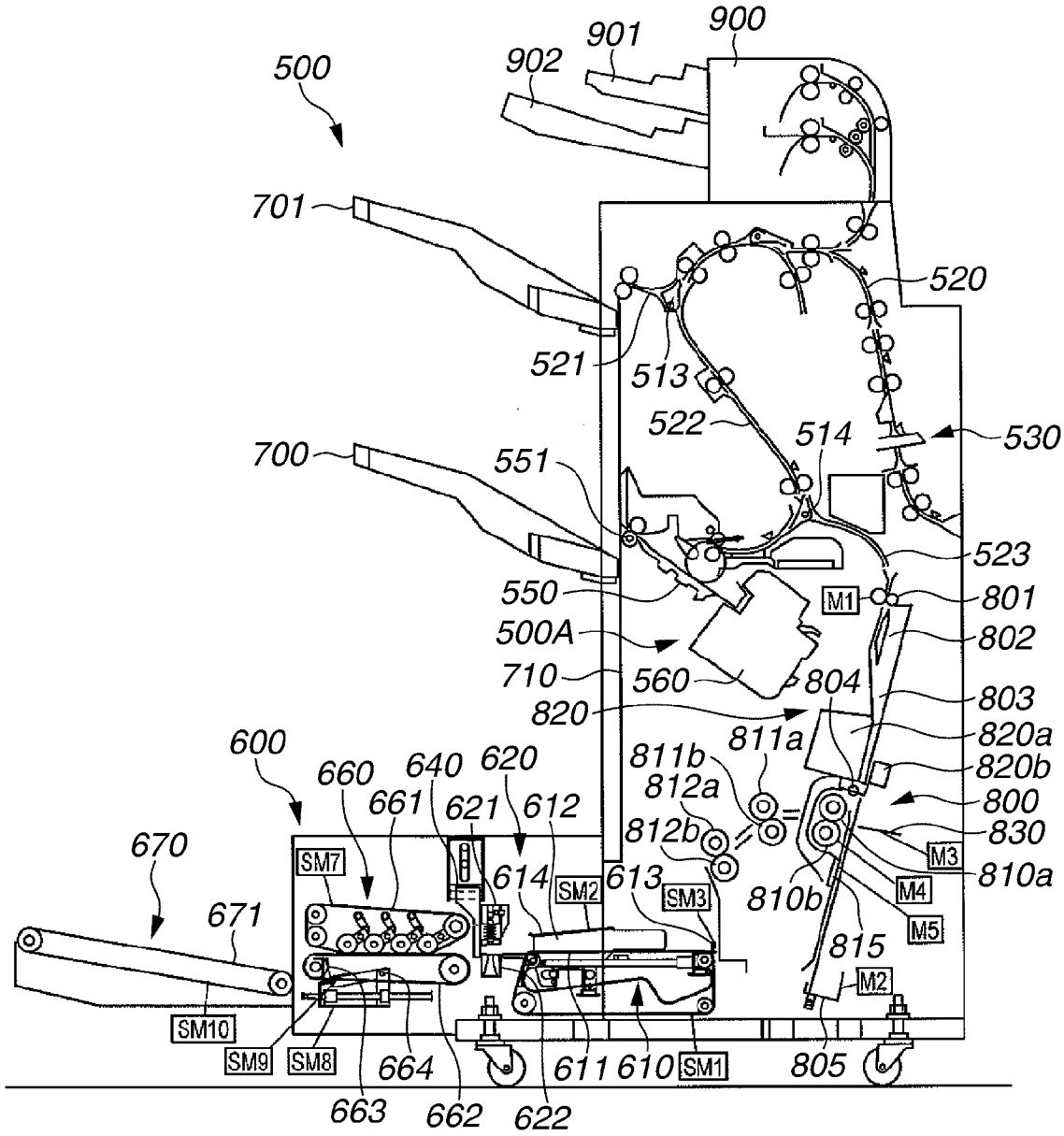
FIG. 2 illustrates a configuration of a finisher that can serve as the sheet processing apparatus.

Each sheet S with an image formed thereon is conveyed into the finisher 500 via the folding processing unit 400. The finisher 500 can perform various processing on sheets received from the copying machine body 300. More specifically, the finisher 500 performs processing for aligning a plurality of sheets and bundling the aligned sheets as a single sheet bundle, as well as sort processing and non-sort processing. The finisher 500 can further perform staple processing (i.e., binding processing) for stapling the rear end side of the sheet bundle in the conveyance direction and bookbinding processing. As illustrated in FIG. 2, the finisher 500 includes the staple unit 500A that can staple a plurality of sheets and the saddle stitch binding unit 800 (i.e., the bookbinding unit) that can fold the sheet bundle for bookbinding.

The finisher 500, as illustrated in FIG. 2, includes a conveyance path 520 via which the sheet conveyed from the folding processing unit 400 can be supplied to the inside of the apparatus. A plurality of conveyance roller pairs is provided along the conveyance path 520. A punch unit 530, which is provided near the conveyance path 520, can perform punching processing on the rear edge portion of a sheet conveyed in the conveyance direction.

A switching means 513 is provided at a rear end of the conveyance path 520. The switching means 513 can switch the conveyance path to an upper sheet discharge path 521 or a lower sheet discharge path 522 that are connected to the downstream side in the conveyance direction. The upper sheet discharge path 521 can be used to discharge a sheet to an upper stack tray 701. The lower sheet discharge path 522 can be used to discharge a sheet to a process tray 550.

The sheets discharged via the lower sheet discharge path 522 to the process tray 550 are successively subjected to alignment processing and are accommodated as a bundle. The sheets are further subjected to sorting processing and staple processing according to user's settings entered via the operation unit 1 illustrated in FIG. 1. A stapler 560, which is movable in the width direction, performs staple processing on the sheets at arbitrary positions.

The sheets having been subjected to the sorting processing and the staple processing are discharged by a bundle discharge roller pair 551 to the upper stack tray 701 or a lower stack tray 700. A rear end guide 710, which extends in the vertical direction, can regulate and align the rear ends of the sheets discharged in the upper and lower stack trays 700 and 701.

The upper stack tray 701 and the lower stack tray 700 are movable in the vertical direction. The upper stack tray 701 can receive sheets from the upper sheet discharge path 521 and the process tray 550. The lower stack tray 700 can receive sheets from the process tray 550. A great amount of sheets can be stored in the upper stack tray 701 and the lower stack tray 700 by moving the upper stack tray 701 and the lower stack tray 700 in the vertical direction.

As illustrated in FIG. 2, an inserter 900 is provided on the finisher 500. The inserter 900 can supply head and final pages to be added to a sheet bundle and can insert an insert sheet (i.e., a sheet different from the sheets constituting the sheet bundle) between sheets on which images are formed by the copying machine body 300.

When an insert sheet is inserted, the inserter 900 supplies the insert sheet set on the insert tray 901 or 902 by a user to the conveyance path 520 at desired timing. Then, the insert sheet supplied to the conveyance path 520 can be conveyed to any one of the upper stack tray 701, the process tray 550, and the saddle stitch binding unit 800.

A switching means 514 is provided at a predetermined position of the lower sheet discharge path 522. When the finisher 500 performs saddle stitch processing on sheets, the switching means 514 switches the conveyance path to guide the sheets to a saddle sheet discharge path 523. The sheets are conveyed to the saddle stitch binding unit 800. More specifically, a sheet having passed through the saddle sheet discharge path 523 is received by a saddle inlet roller pair 801. A switching means 802, which can be driven by a solenoid, selects an inlet port according to a size of the conveyed sheet. The sheet is conveyed into an accommodating guide 803 of the saddle stitch binding unit 800.

A sliding roller 804 conveys the entered sheet until the front end of the sheet in the conveyance direction reaches a movable sheet positioning means 805. The saddle inlet roller pair 801 and the sliding roller 804 can be driven by a motor M1. A stapler 820 is provided near the accommodating guide 803. The stapler 820 includes a driver 820*a* and an anvil 820*b* which are positioned in a confronting relationship on the opposite sides of the accommodating guide 803. The driver 820*a* can push out a staple (not illustrated). The anvil 820*b* can bend distal ends of the protruded staple.

The sheet positioning means 805 is movable in the vertical direction when it is driven by a motor M2. The sheet positioning means 805 can change its vertical position according to the size of each sheet. When a conveyed sheet is stopped by the sheet positioning means 805, a central portion of the sheet in the conveyance direction agrees with a stitch position of the stapler 820.

A pair of folding rollers 810*a* and 810*b* is provided on the downstream side of the stapler 820 in the conveyance direction. A pushing member 830 is provided in a confronting relationship with the folding rollers 810*a* and 810*b*. The pushing member 830 retreats from the accommodating guide 803 at its home position and can protrude toward an accommodated sheet bundle when it is driven by a motor M3.

When the pushing member 830 protrudes toward the sheet bundle and presses the sheet bundle, the sheet bundle is folded and nipped by the folding rollers 810*a* and 810*b*. This operation is referred to as folding processing. An alignment plate pair 815 has a surface that surrounds the folding rollers 810*a* and 810*b* and protrudes against the accommodating guide 803. The alignment plate pair 815 can align a plurality of sheets stored in the accommodating guide 803. The alignment plate pair 815 can move in a nipping direction relative to the sheets, when it is driven by a motor M5. The sheets can be positioned in the width direction by the alignment plate pair 815.

The folding rollers 810*a* and 810*b* are pressed against each other by a spring (not illustrated) that gives a sufficient pressing force F1 to fold the sheet bundle. The pushing member 830 returns to the home position again after the sheet bundle is nipped between the folding rollers 810*a* and 810*b*.

A pair of first folding conveyance rollers 811*a* and 811*b* and a pair of second folding conveyance rollers 812*a* and 812*b* can discharge the folded sheet bundle to the saddle stitch booklet processing unit 600. The first folding conveyance rollers 811*a* and 811*b* are pressed against each other by a resilient member (not illustrated) that gives a sufficient pressing force F2 to fold the sheet bundle. Similarly, the second folding conveyance rollers 812*a* and 812*b* are pressed against each other by a resilient member (not illustrated) that gives a sufficient pressing force F3 to fold the sheet bundle. A single motor M4 (i.e., a common motor) can drive the folding rollers 810*a* and 810*b*, the first folding conveyance rollers 811*a* and 811*b*, and the second folding conveyance rollers 812*a* and 812*b* so that these rollers can synchronously rotate at the same speed.

Figure 3:
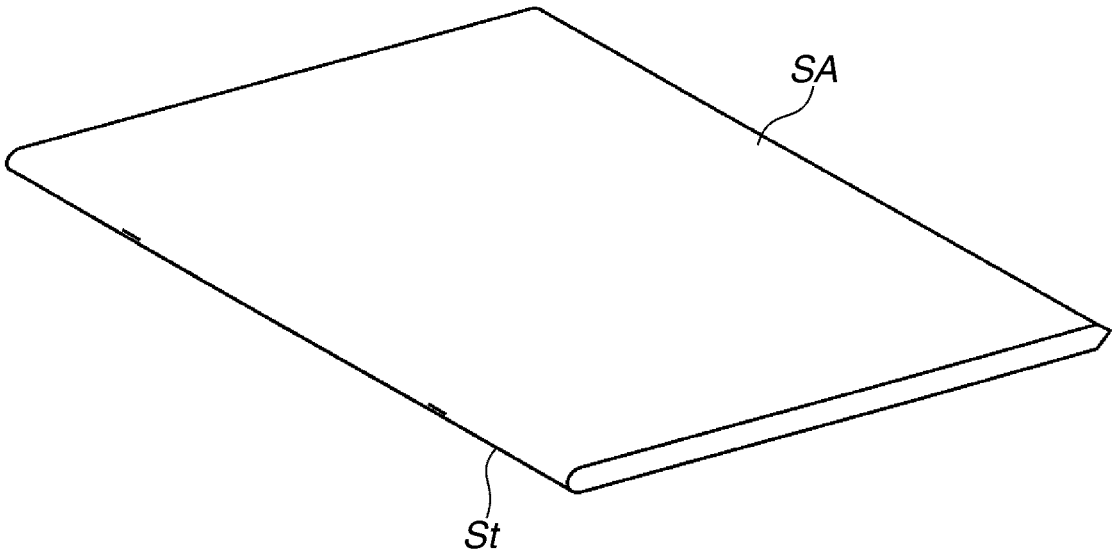
FIG. 3 is a perspective view illustrating a booklet that can be obtained by a saddle stitch binding unit of the finisher.

After finishing the staple processing, the sheet positioning means 805 moves downward a predetermined distance from the position where the sheet bundle has been subjected to the staple processing, so that the staple position of the sheet bundle agrees with the nip position of the folding rollers 810*a* and 810*b*. Then, a booklet (i.e., a folded sheet bundle) SA can be obtained by folding the sheet bundle along a line corresponding to the staple position as illustrated in FIG. 3.

Figure 4:
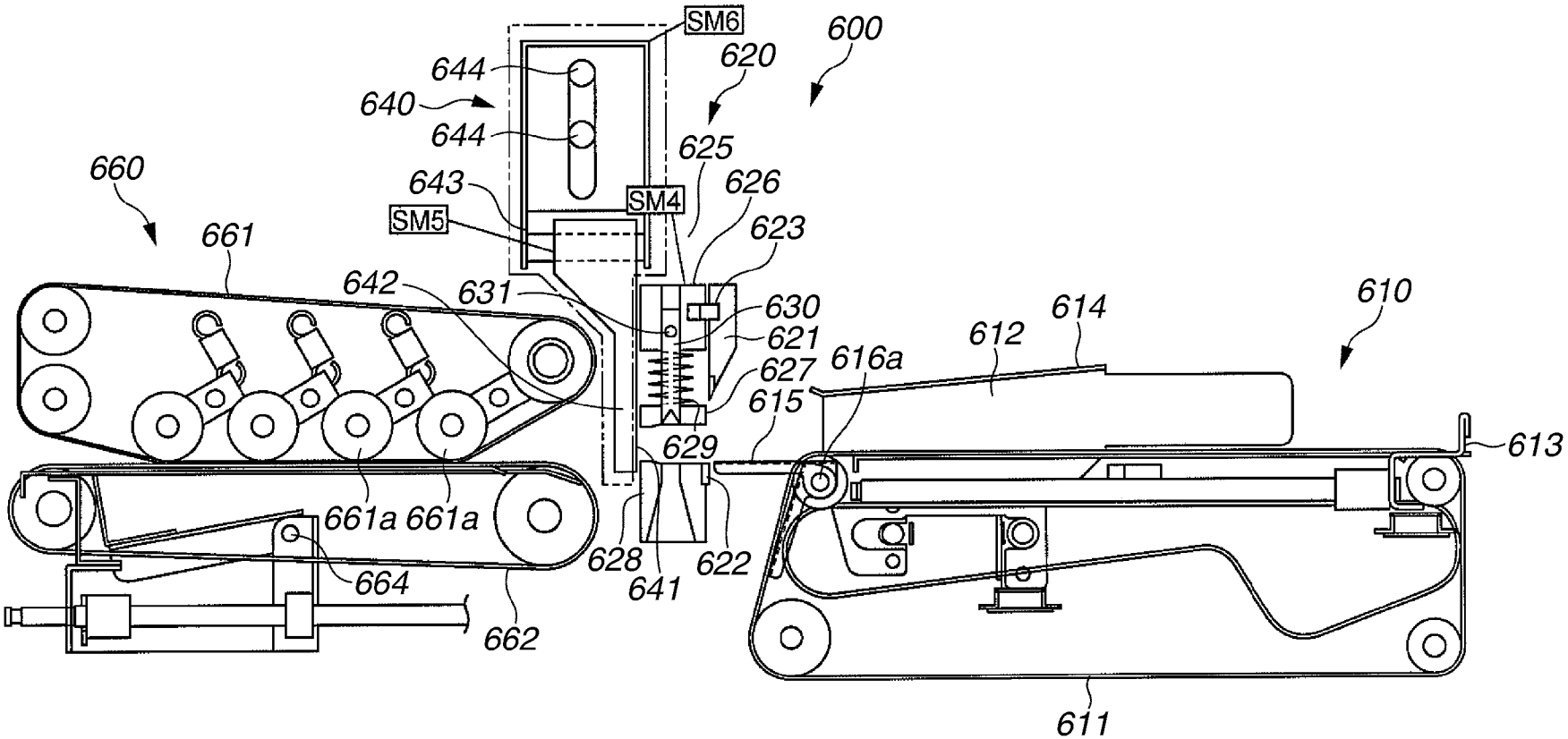
FIG. 4 illustrates a configuration of a saddle stitch booklet processing unit provided in the finisher.

In the present exemplary embodiment, as illustrated in FIG. 2, the saddle stitch booklet processing unit 600 is provided on the downstream side of the saddle stitch binding unit 800 in the conveyance direction. The saddle stitch booklet processing unit 600 can perform finishing processing on a folded spinal portion of a booklet (i.e., a sheet bundle finished by the saddle stitch bookbinding processing). The saddle stitch booklet processing unit 600 includes a booklet reception unit 610, a booklet processing unit 620, and a bundle conveyance unit 660, as illustrated in FIG. 4. The saddle stitch booklet processing unit 600 and the saddle stitch binding unit 800 cooperatively constitute the finisher 500 (i.e., the sheet processing apparatus according to the present exemplary embodiment).

The booklet reception unit 610 receives a folded sheet bundle from the saddle stitch binding unit 800 and conveys the received bundle. To this end, the booklet reception unit 610 includes a lower conveyance belt 611 that can receive a folded sheet bundle from the saddle stitch binding unit 800 and convey the received bundle. The lower conveyance belt 611 is rotating in the conveyance direction when the lower conveyance belt 611 receives the folded sheet bundle. Therefore, even if a folded sheet bundle falls from the second folding conveyance rollers 812*a* and 812*b* with its folded spinal portion as a leading end, the folded sheet bundle does not rotate and can be received by the lower conveyance belt 611 without changing its orientation in the conveyance direction.

A side guide pair 612 is positioned across the lower conveyance belt 611, in such a manner as to extend in the width direction perpendicular to the conveyance direction of the lower conveyance belt 611. The side guide pair 612 can move in the width direction of a folded sheet bundle to correct the position of the folded sheet bundle in the width direction. A pressing guide 614, which is formed on an upper side of the side guide pair 612, can prevent a folded sheet bundle from opening. The pressing guide 614 can function as a guide capable of smoothly conveying each folded sheet bundle to the downstream side in the conveyance direction.

Figure 6:
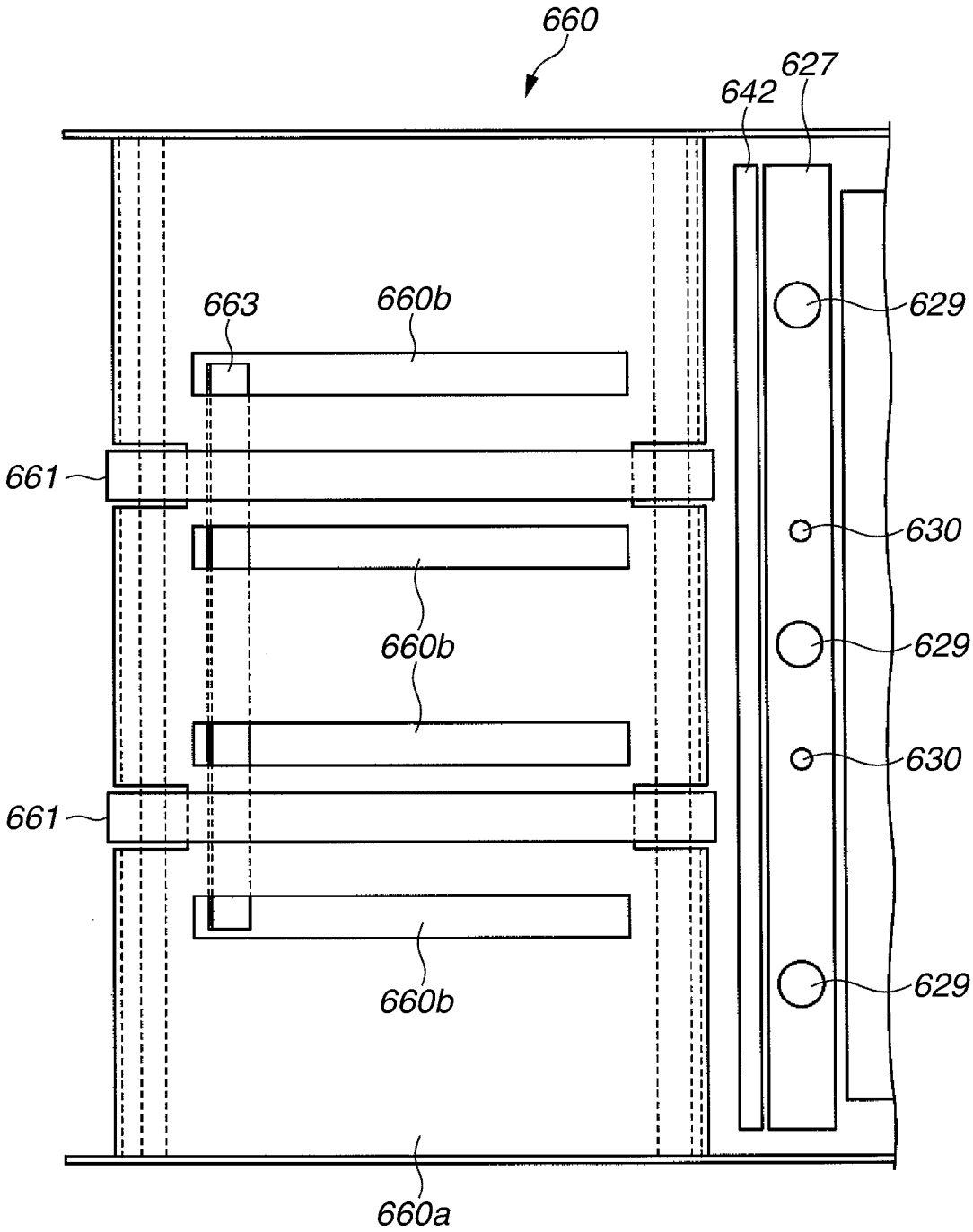
FIG. 6 illustrates a configuration of a bundle conveyance unit provided in the saddle stitch booklet processing unit.

Conveyance claws 613 are disposed on both sides of the lower conveyance belt 611 in the width direction. The conveyance claws 613 can move in parallel with the lower conveyance belt 611 at the same speed as illustrated in FIG. 6. If any slip is caused between a folded sheet bundle and the lower conveyance belt 611, the conveyance claws 613 contact a rear end of the folded sheet bundle in the conveyance direction and push the folded sheet bundle while it moves.

In this manner, the conveyance claws 613 provided as pressing members can surely push the rear end of each folded sheet bundle to the downstream side in the conveyance direction and can press the folded spinal portion of the folded sheet bundle against a deforming or squashing member 642 as described below. The lower conveyance belt 611, the side guide pair 612, and the conveyance claws 613 can be driven by motors SM1, SM2, and SM3 illustrated in FIG. 2, respectively.

Figure 5:
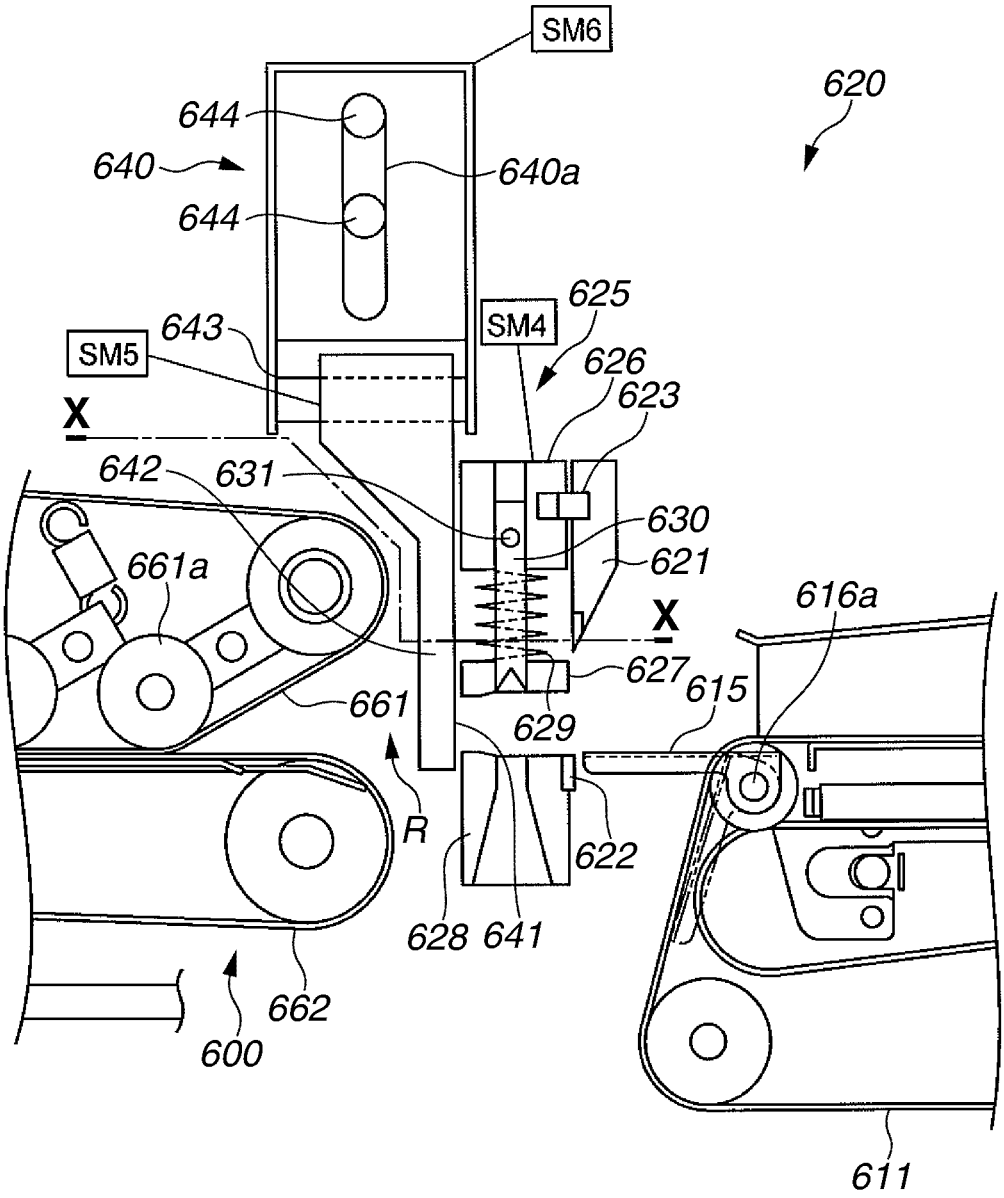
FIG. 5 illustrates a configuration of a booklet processing unit provided in the saddle stitch booklet processing unit.

The booklet processing unit 620 includes upper and lower cutting blades 621 and 622 that can cut a folded sheet bundle as illustrated in FIG. 5. The booklet processing unit 620 further includes a pressing unit 625 and a punch 630. The pressing unit 625 can serve as a gripping unit configured to press a folded sheet bundle in the vertical direction. The punch 630, which is disposed in the pressing unit 625, can open a hole at a predetermined position of the folded sheet bundle. The booklet processing unit 620 further includes a deforming or squashing unit 640 that can serve as a deforming processing unit. The deforming unit 640 can regulate the position of a front end (i.e., a folded spinal portion) of a folded sheet bundle in the conveyance direction. The deforming unit 640 can push against the curved front end and deform the folded spinal portion to create a substantially flat surface along the folded spinal portion, the substantially flat surface being substantially perpendicular to the front and rear cover of the sheet bundle.

The pressing unit 625 includes a pressing base 626, an upper pressing plate 627, and a lower pressing plate 628. The pressing base 626 can move in the vertical direction when it is driven by a motor SM4. The upper pressing plate 627 is connected to the pressing base 626 via a connection member (not illustrated). The lower pressing plate 628 is fixed to a frame in an opposed relationship with the upper pressing plate 627. A deformion spring 629 is disposed between the pressing base 626 and the upper pressing plate 627.

As illustrated in FIG. 5, in a state where the pressing base 626 is located at an upper predetermined standby position (hereinafter, referred to as an upper position), the upper and lower pressing plates 627 and 628 (i.e., gripping members) are separated so that a folded sheet bundle can be conveyed into an opened space between two plates 627 and 628. In a state where the pressing base 626 is located at a down position (hereinafter, referred to as a lower position) where a folded sheet bundle is processed, the deformion spring 629 expands or shrinks according to the thickness of each folded sheet bundle while the upper and lower pressing plates 627 and 628 surely grip and fix the folded sheet bundle.

The lower cutting blade 622 is fixed to an upstream end of the lower pressing plate 628 in the conveyance direction. The upper cutting blade 621 is constantly urged upward by a spring (not illustrated). In a state where the pressing base is located at the upper position, the upper cutting blade can be connected to the pressing base 626 via a first connecting pin 623.

The first connecting pin 623 can be driven by a solenoid (not illustrated), which can selectively connect or disconnect the pressing base 626 with or from the upper cutting blade 621. If the pressing base 626 moves downward in a state where the pressing base 626 and the upper cutting blade 621 are connected with the first connecting pin 623, the upper cutting blade 621 moves together with the lowering pressing base 626. Then, the upper cutting blade 621 and the lower cutting blade cooperatively cut a folded sheet bundle. In other words, in the present exemplary embodiment, the upper cutting blade and the lower cutting blade 622 can serve as a cutting unit configured to cut a rear (i.e., non-stitched) edge portion of a folded sheet bundle that is located on an opposite side in the conveyance direction relative to the folded spinal portion (i.e., the front end).

The punch 630 can slide in vertical holes of the pressing base 626 and the upper pressing plate 627. Similar to the upper cutting blade 621, the punch 630 is constantly urged upward by a spring (not illustrated). The punch 630 can be connected to the pressing base 626 at the upper position via a second connecting pin 631. The second connecting pin 631 can be driven by a solenoid (not illustrated), which can selectively connect or disconnect the pressing base 626 with or from the punch 630.

If the pressing base 626 moves downward in a state where the pressing base 626 and the punch 630 are connected with the second connecting pin 631, the punch 630 moves together with the lowering pressing base 626 and reaches a receiving hole of the lower pressing plate 628 to open a punch hole at a predetermined position of a sheet bundle. In the present exemplary embodiment, the shape of a punch hole maybe a circular one. Two punch holes may be opened in the back-and-forth direction to realize a two-hole punch. The punch 630 has a front end configured into a V-shaped groove, which can reduce a resistive force that may act when a bundle is punched.

The deforming member 642 of the deforming unit 640 has a flat deforming surface 641 against which the front end of a folded sheet bundle moving in the conveyance direction can collide. The deforming member 642 is supported by a rail 643 and can be driven by a motor SM5 in such a way as to move in parallel with the conveyance direction. The deforming member 642 can be brought into contact with the pressing unit 625 and can be separated from the pressing unit 625.

The deforming unit 640 includes an elongated guide hole 640*a* extending in the vertical direction. Two shafts 644, which are fixed to a frame, are inserted in the guide hole 640*a*. The deforming unit 640, when it is driven by a motor SM6, can move in the vertical direction while the shafts 644 are guided along the guide hole 640*a*. The deforming member 642 can retreat from the conveyance path R when the deforming unit 640 moves upward and reaches the upper position. In this state, a folded sheet bundle can be freely conveyed.

On the other hand, if the deforming unit 640 moves downward and reaches the lower position as illustrated in FIG. 5, the deforming member 642 protrudes across the conveyance path R and blocks the conveyance path R. In this state, the folded spinal portion of a conveyed folded sheet bundle collides against the deforming member 642 and is stopped.

In FIG. 5, a shutter guide 615 is provided to surely convey a folded sheet bundle from the booklet reception unit 610 to the booklet processing unit 620. The shutter guide 615 can swing in a vertical plane around a pulley shaft 616*a* of the lower conveyance belt 611 in synchronization with an up-and-down motion of the upper cutting blade 621. The shutter guide 615 is linked with the upper cutting blade 621 via a cam (not illustrated) fixed to the upper cutting blade 621.

When a folded sheet bundle is conveyed in a state where the pressing base 626 and the upper cutting blade 621 are located at the upper position, the shutter guide 615 guides the folded sheet bundle horizontally as illustrated in FIG. 5 (see a solid line position). When the upper cutting blade 621 moves downward and cuts a folded sheet bundle, the shutter guide 615 rotates downward to let scrap fall from the conveyance path R (see a dotted line position).

The bundle conveyance unit 660, which is a unit configured to convey a folded sheet bundle, includes upper and lower conveyance belts 661 and 662 that can travel at the same speed to convey a folded sheet bundle nipped between them. The upper conveyance belt 661 is associated with a plurality of guide rollers 661*a*, which support the upper conveyance belt 661 from the inside. The position of each guide roller 661*a* is changeable according to the thickness of each folded sheet bundle.

A positioning stopper 663 is positioned in the vicinity of the lower conveyance belt 662, as illustrated in FIG. 6. The positioning stopper 663 can move in the conveyance direction in parallel with the lower conveyance belt 662. The positioning stopper 663 can swing around a pivot shaft 664 illustrated in FIG. 4 between a position where the positioning stopper 663 retreats from the conveyance path and a position where the positioning stopper 663 protrudes from a guide member 660*a* that constitutes a bottom surface of the conveyance path via elongated holes 660*b* extending in the conveyance direction.

The upper and lower conveyance belts 661 and 662 can be driven by a motor SM7 illustrated in FIG. 2. A stopper moving motor SM8, which serves as a stopper moving unit, can move the positioning stopper 663. A swing motion of the positioning stopper 663 can be driven by a motor SM9 illustrated in FIG. 2.

In FIG. 2, a conveyor tray 670 can receive a folded sheet bundle when it is discharged from the bundle conveyance unit 660. A conveyor belt 671, which is provided on a lower surface of the conveyor tray 670, can travel in the conveyance direction when it is driven by a motor SM10. The conveyor belt 671 repeats a predetermined amount of movement every time when a folded sheet bundle is discharged to perform loading of folded sheet bundles. A sensor (not illustrated) can detect the position of each movable member.

Figure 7:
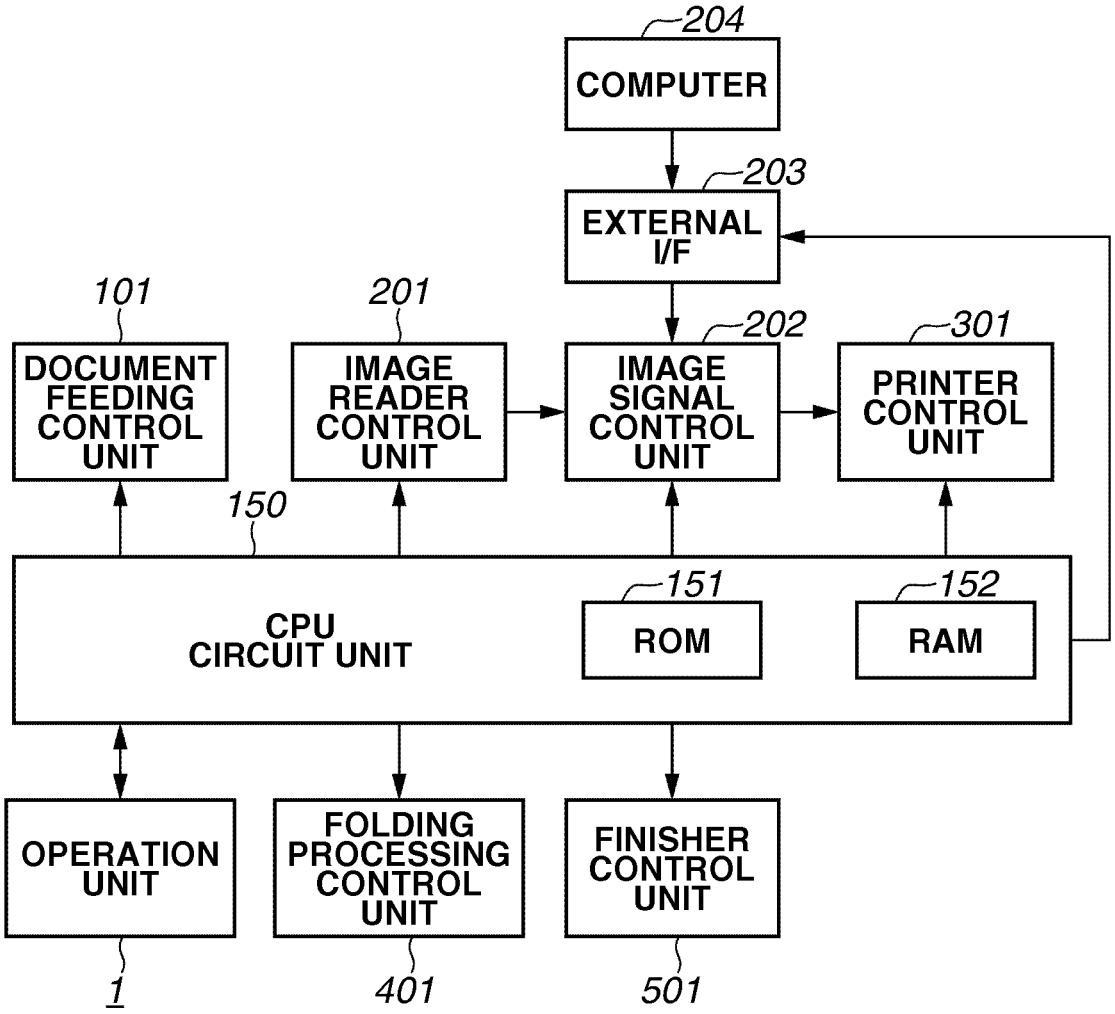
FIG. 7 is a control block diagram of the copying machine.

FIG. 7 is a control block diagram of the copying machine 1000. A central processing unit (CPU) circuit unit 150 includes a CPU (not illustrated) that can control a document feeding control unit 101, an image reader control unit 201, an image signal control unit 202, a printer control unit 301, and a folding processing control unit 401 according to a control program stored in a read only memory (ROM) 151 and user's settings entered via the operation unit 1. The CPU can further control a finisher control unit 501 and an external I/F 203.

The document feeding control unit 101 controls the document feeding unit 100. The image reader control unit 201 controls the scanner 200. The printer control unit 301 controls the copying machine body 300. The folding processing control unit 401 controls the folding processing unit 400. The finisher control unit 501 controls various operations performed by the finisher 500 that includes the staple unit 500A, the saddle stitch booklet processing unit 600, the saddle stitch binding unit 800, and the inserter 900.

In FIG. 7, the operation unit 1 of the copying machine body 300 includes a plurality of keys that enable users to set various functions relating to image forming processing and a display unit that can display a state of settings. The operation unit 1 sends a key signal representing a user's operation on each key to the CPU circuit unit 150. The operation unit 1 displays corresponding information on its display unit based on a signal received from the CPU circuit unit 150. The operation unit 1 serves as a setting unit configured to set deforming processing that can be performed by the deforming unit 640.

A random access memory (RAM) 152 can be used as a storage area that temporarily stores control data and a work area usable for calculations in various controls. The external I/F 203 can serve as an interface between the copying machine 1000 and an external computer 204. When the external I/F 203 receives print data from the computer 204, the external I/F can rasterize the received data into a bitmap image. The external I/F 203 outputs image data of the bitmap image to the image signal control unit 202. The image reader control unit 201 receives an image of a document read by an image sensor (not illustrated) and outputs the image to the image signal control unit 202. The printer control unit 301 receives image data from the image signal control unit 202 and outputs the image data to the exposure control unit 110.

The finisher 500 according to the present exemplary embodiment performs sheet bundle processing (i.e., booklet processing). In the present exemplary embodiment, the finisher control unit 501 can serve as a control unit to realize an operation of the finisher 500 based on communications with the CPU circuit unit 150. Alternatively, the CPU circuit unit 150 may serve as a control unit to directly control the finisher 500.

Figure 8:
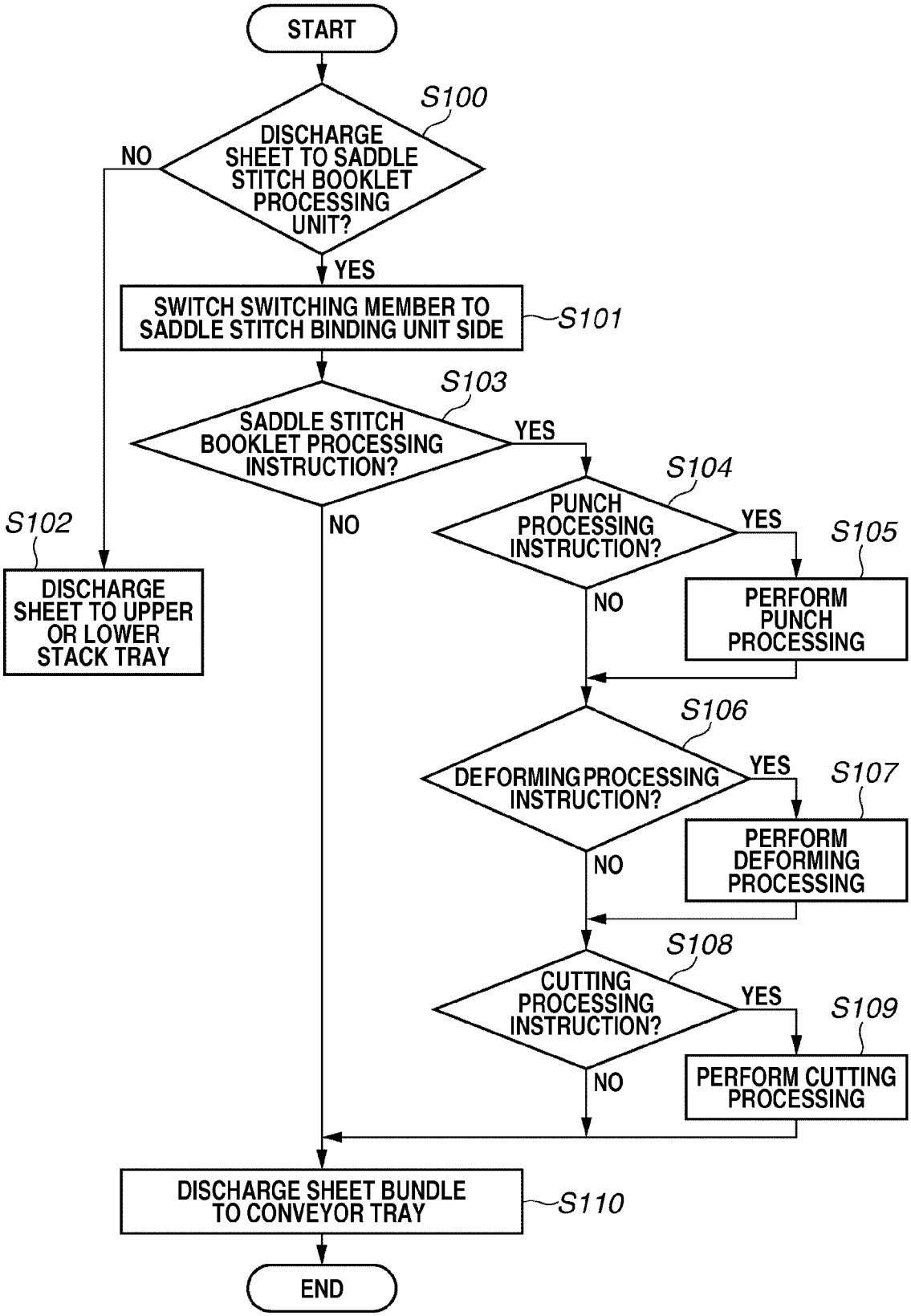
FIG. 8 is a flowchart illustrating booklet processing that can be performed by the finisher.

In step S100 of a flowchart illustrated in FIG. 8, the control unit determines whether a sheet is discharged to the saddle stitch booklet processing unit 600. If it is determined that the sheet is discharged to the saddle stitch booklet processing unit 600 (YES in step S100), then in step S101, the control unit switches the switching means 514 (see FIG. 2) to the saddle stitch binding unit side. If it is determined that the sheet is not discharged to the saddle stitch booklet processing unit 600 (NO in step S100), then in step S102, the control unit discharges the sheet to the upper stack tray 701 or the lower stack tray 700.

Subsequently, a saddle stitch bookbinding sheet bundle (i.e., a booklet) is generated by the saddle stitch binding unit 800, as illustrated in FIG. 3, and is then discharged via the second folding conveyance rollers 812*a* and 812*b* to the booklet reception unit 610. Next, in step S103, the control unit determines whether the saddle stitch booklet processing is instructed. If it is determined that a saddle stitch booklet processing mode is not selected (NO in step S103), then in step S110, the control unit discharges the folded sheet bundle to the conveyor tray 670 via the lower conveyance belt 611, the conveyance claws 613, and the upper and lower conveyance belts 661 and 662. In this case, the side guide pair 612, the upper pressing plate 627, the deforming unit 640, and the positioning stopper 663 are in their retreat positions and do not block the conveyance path.

Figure 9:
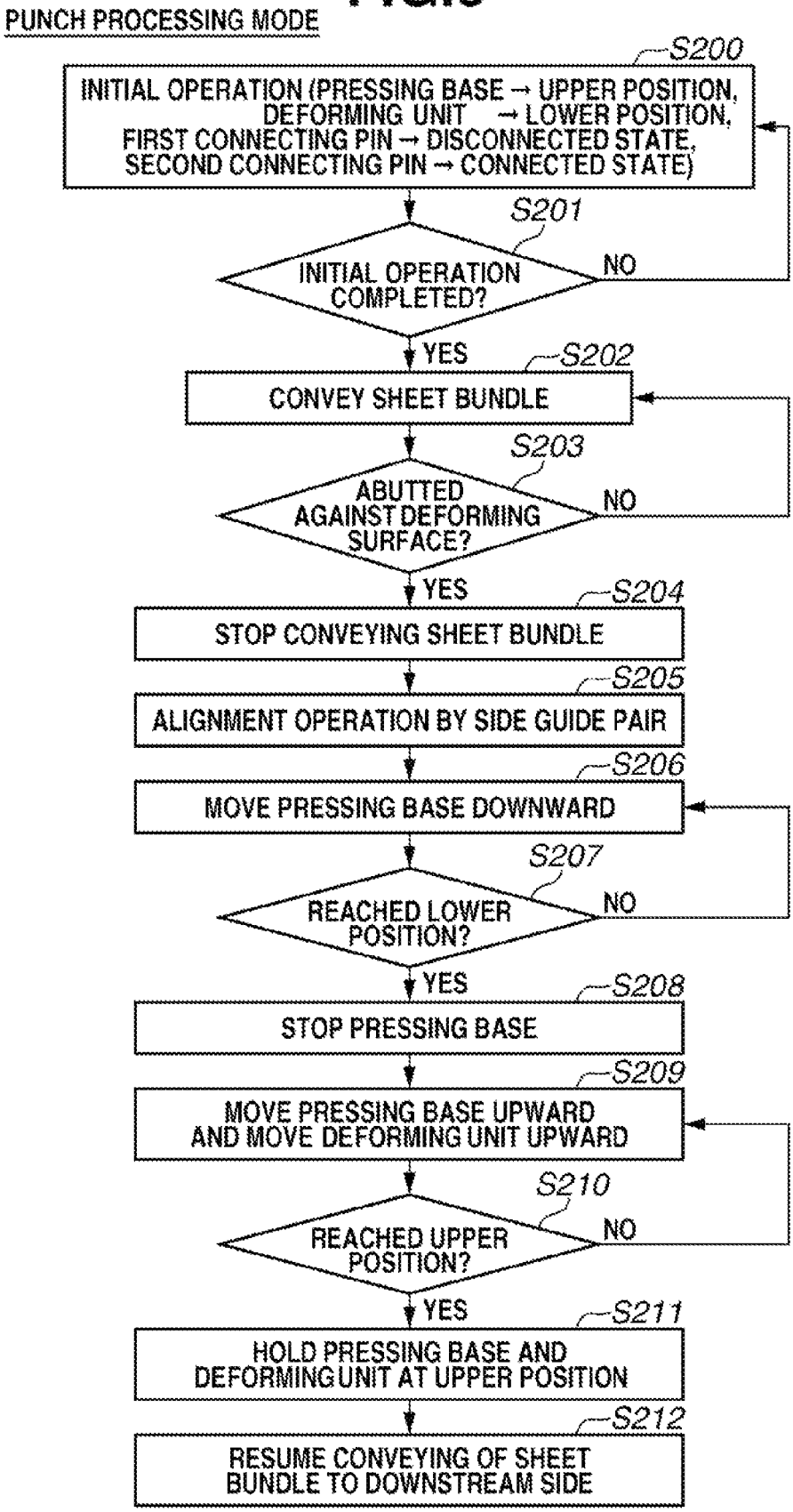
FIG. 9 is a flowchart illustrating punch processing that can be performed as part of the booklet processing.

If it is determined that the saddle stitch booklet processing mode is selected (YES in step S103), then in step S104, the control unit determines whether the punch processing is instructed. If it is determined that the punch processing is instructed (YES in step S104), namely, if a punch processing mode is selected by a user via the operation unit 1, then in step S105, the control unit performs the punch processing according to a flowchart illustrated in FIG. 9.

More specifically, in step S200, the control unit performs the following initial operation to start the punch processing. The control unit moves the pressing base 626 to the upper position and moves the deforming unit 640 to the lower position before a folded sheet bundle SA is discharged to the booklet reception unit 610. The control unit brings the second connecting pin 631 into a connected state to engage the punch 630 with the pressing base 626. The control unit brings the first connecting pin 623 into a disconnected state to disengage the upper cutting blade 621 from the pressing base 626. When the deforming unit 640 reaches the lower position, the deforming member 642 blocks the conveyance path R. This position can be referred to as a standby position.

Figure 11:
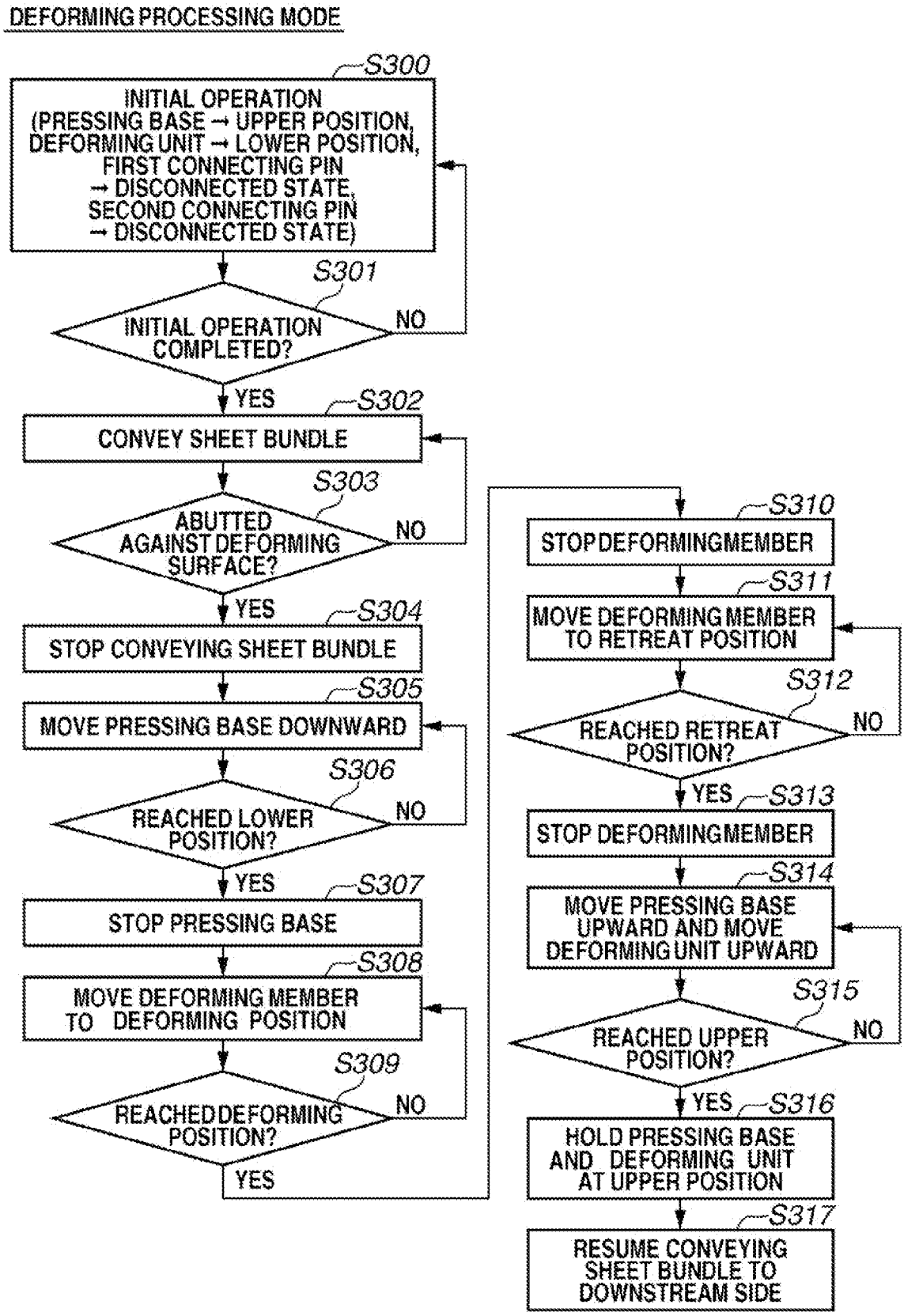
FIG. 11 is a flowchart illustrating deforming processing that can be performed as part of the booklet processing.

If it is determined that the above-described initial operation is completed (YES in step S201), then in step S202, the control unit drives the motors SM1 and SM2 to cause the lower conveyance belt 611 and the conveyance claws 613 to convey the folded sheet bundle SA. Then, in step S203, the control unit determines whether the folded spinal portion (i.e., a protruding portion) of the conveyed folded sheet bundle SA has collided against the deforming surface 641 of the deforming member 642. If it is determined that the folded spinal portion of the folded sheet bundle SA abuts against the pressing surface (i.e., the deforming surface 641 of the deforming member 642) as illustrated in FIG. 11A (YES in step S203), then in step S204, the control unit stops conveying the folded sheet bundle SA. Then, in step S205, the control unit causes the side guide pair 612 to perform a nipping operation (i.e., an alignment operation) to adjust the position of the folded sheet bundle SA in both the conveyance direction and the width direction.

Figure 10A:
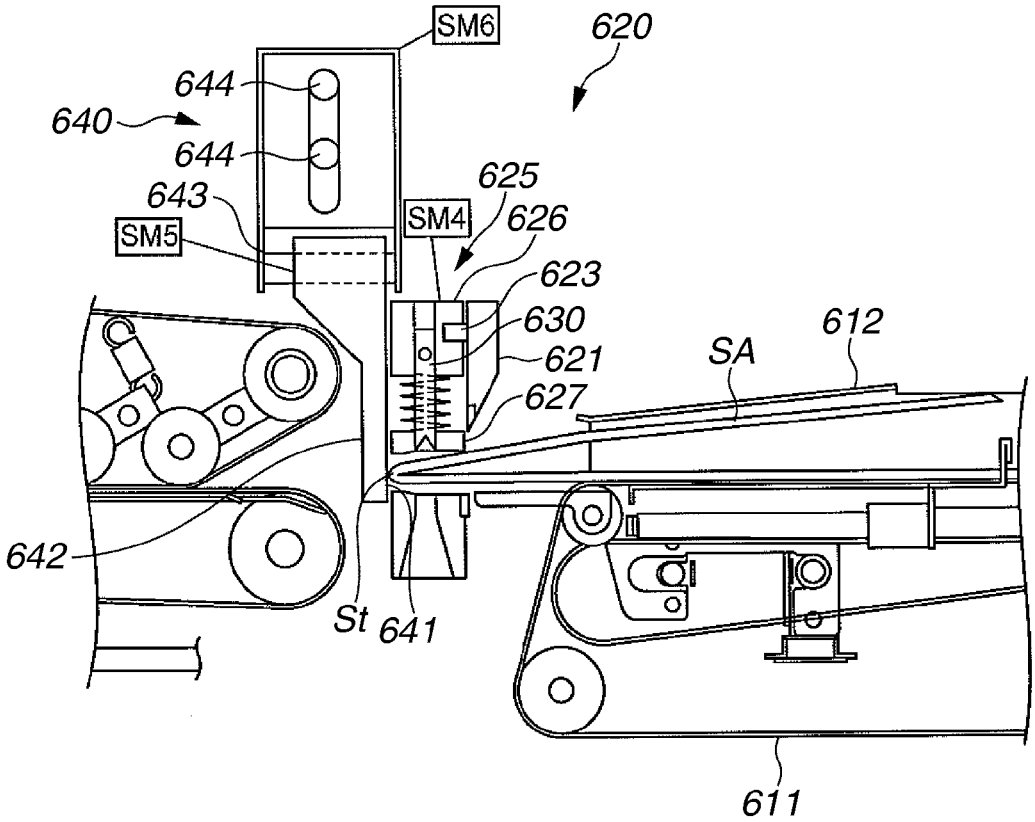
FIGS. 10A and 10B illustrate punch processing that can be performed by the booklet processing unit.
Figure 10B:
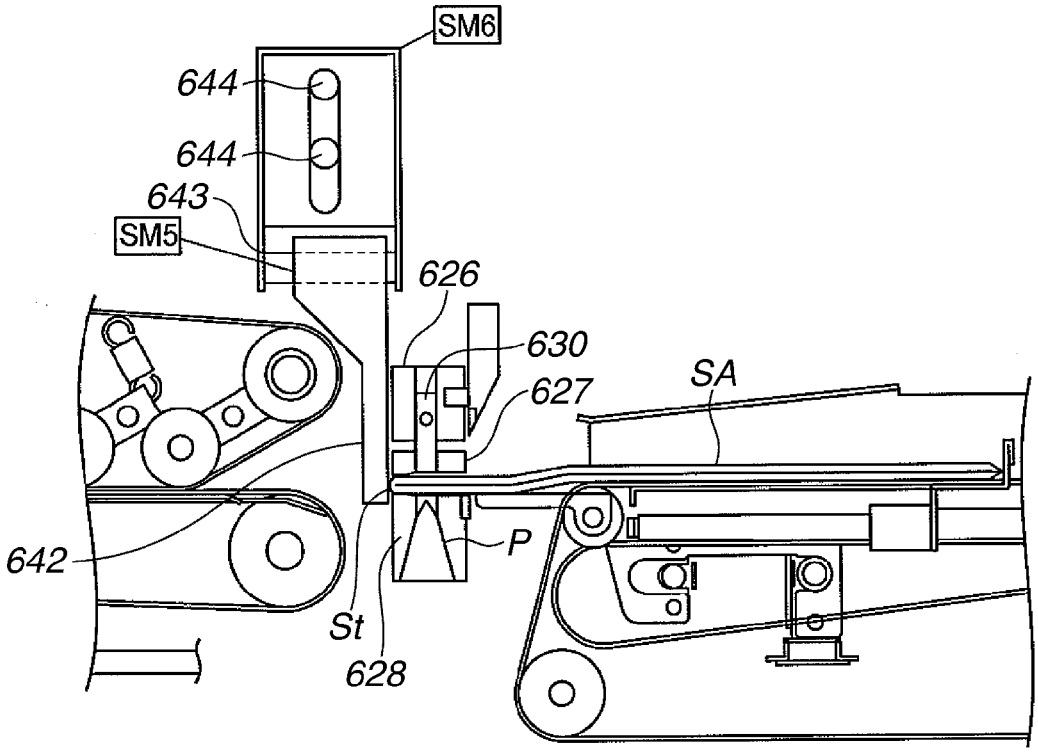

In step S206, the control unit drives the motor SM4 to move the pressing base 626 downward together with the upper pressing plate 627 and the punch 630 as illustrated in FIG. 10B. In the process of lowering the pressing base 626, the upper pressing plate 627 contacts an upper surface of the folded sheet bundle. Then, the pressing base 626 further moves downward while deforming the deformion spring 629.

In step S207, the control unit determines whether the pressing base 626 has reached the lower position. If it is determined that the pressing base 626 has reached the lower position (YES in step S207), then in step S208, the control unit deactivates the motor SM4 to stop the pressing base 626. In a state where the pressing base 626 is stopped, the folded sheet bundle SA is firmly clamped by the upper and lower pressing plates 627 and 628.

As the punch 630 is engaged with the pressing base 626, the punch 630 moves downward together with the pressing base 626. The lower end of the punch 630 can shift across the sheet S into the receiving hole of the lower pressing plate 628. Thus, the punch 630 opens two punch holes at predetermined positions of the folded sheet bundle SA. The position of the punch in the conveyance direction can be determined by the position where the deforming surface 641 stops a folded sheet bundle. Accordingly, to open a punch hole at a desired position, the control unit can control the motor SM5 to adjust the stop position of the deforming member 642 in the conveyance direction. The generated scrap falls into a scrap box (not illustrated) positioned below the punch 630.

Next, in step S209, the control unit drives the motor SM4 in the reverse direction to move the pressing base 626 to the upper position so that the folded sheet bundle SA can be released from the upper pressing plate 627 and the punch 630. The control unit further drives the motor SM6 in the reverse direction to move the deforming unit 640 to the upper position. In step S210, the control unit determines whether the pressing base 626 and the deforming unit 640 have reached their upper positions. If it is determined that the pressing base 626 and the deforming unit 640 have reached their upper positions (YES in step S210), then in step S211, the control unit deactivates the motors SM4 and SM6 to hold the pressing base 626 and the deforming unit 640 at their upper positions. In step S212, the control unit drives the lower conveyance belt 611, the conveyance claws 613, and the upper and lower conveyance belts 661 and 662 to restart conveying the folded sheet bundle SA. Thus, the folded sheet bundle SA can be conveyed to the downstream side in the conveyance direction.

Next, after completing the above-described punch processing, in step S106 of FIG. 8, the control unit determines whether the deforming processing is instructed. If it is determined that the deforming processing is instructed (YES in step S106), i.e., if a deforming processing mode is selected, then in step S107, the control unit performs the deforming processing according to a flowchart illustrated in FIG. 11.

More specifically, in step S300, the control unit performs the following initial operation to start the deforming processing. The control unit moves the pressing base 626 to the upper position and moves the deforming unit 640 to the lower position before the folded sheet bundle SA is discharged to the booklet reception unit 610. The control unit brings the second connecting pin 631 into a disconnected state to disengage the punch 630 from the pressing base 626. The control unit brings the first connecting pin 623 into a disconnected state to disengage the upper cutting blade 621 from the pressing base 626. When the deforming unit 640 reaches the lower position, the deforming member 642 reaches the standby position.

Figure 12A:
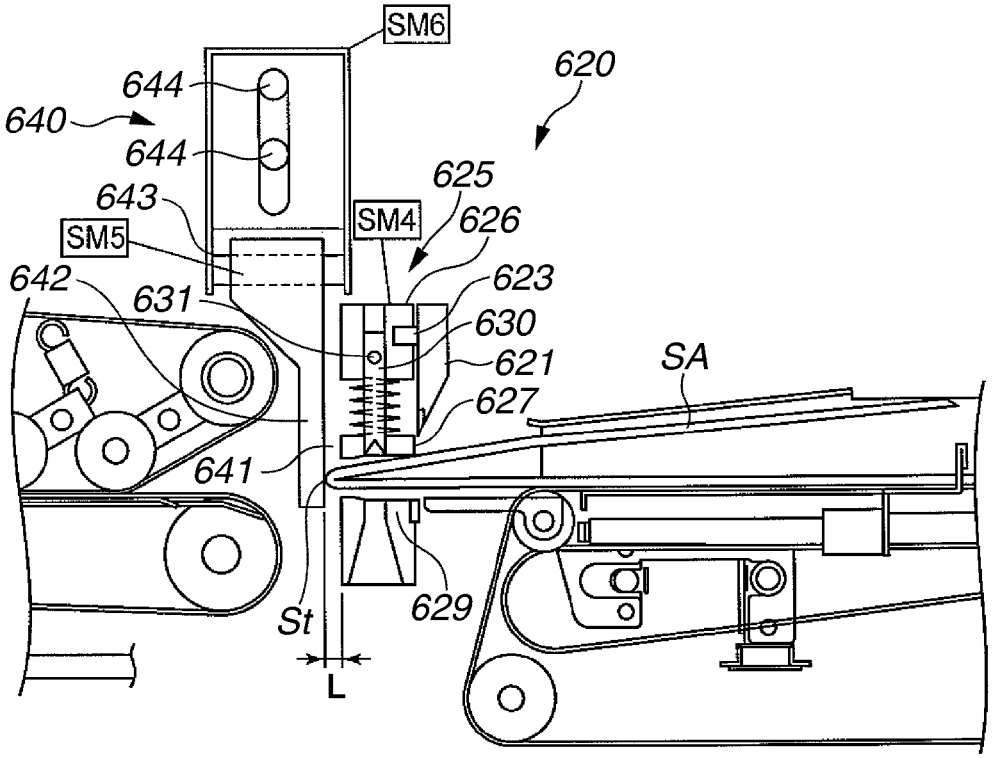
FIGS. 12A and 12B illustrate deforming processing that can be performed by the booklet processing unit.

If it is determined that the above-described initial operation is completed (YES in step S301), then in step S302, the control unit drives the motors SM1 and SM2 to cause the lower conveyance belt 611 and the conveyance claws 613 to convey the folded sheet bundle SA. Then, in step S303, the control unit determines whether the folded spinal portion of the conveyed folded sheet bundle SA has collided against the deforming surface 641 of the deforming member 642. If it is determined that the folded spinal portion of the folded sheet bundle SA abuts against the deforming surface 641 of the deforming member 642 as illustrated in FIG. 12A (YES in step S303), then in step S304, the control unit stops conveying the folded sheet bundle SA. In this case, the deforming surface 641 of the deforming member 642 is spaced from the upper and lower pressing plates 627 and 628 by an amount of a distance (separation amount) L in the conveyance direction.

Then, in step S305, the control unit causes the side guide pair 612 to perform a nipping operation to adjust the position of the folded sheet bundle SA in both the conveyance direction and the width direction. Then, the control unit drives the motor SM4 to move the pressing base 626 downward. In step S306, the control unit determines whether the pressing base 626 has reached the lower position. If it is determined that the pressing base 626 has reached the lower position (YES in step S306), then in step S307, the control unit deactivates the motor SM4 to stop the pressing base 626.

Figure 12B:
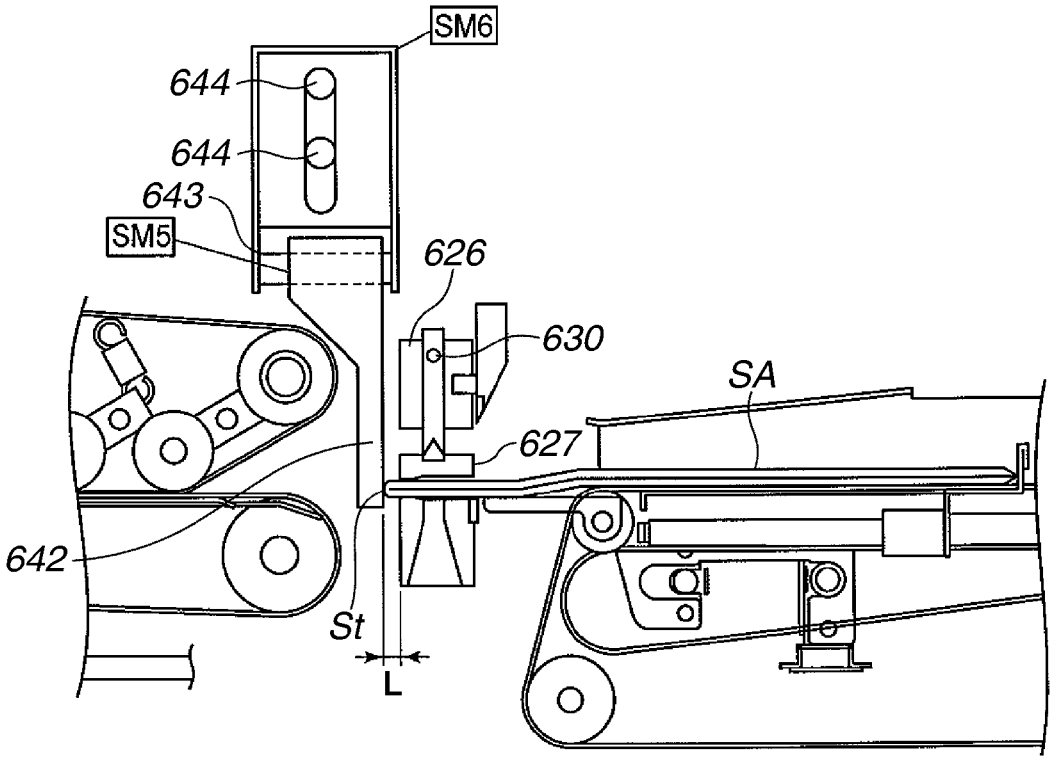

When the pressing base 626 is stopped, the folded sheet bundle SA is clamped between the upper and lower pressing plates 627 and 628 in a state where the folded spinal portion St of the folded sheet bundle SA protrudes from the pressing plates 627 and 628, as illustrated in FIG. 12B. In the state illustrated in FIG. 12B, the punch processing mode is not set. Therefore, the punch 630 does not move. If the punch processing mode is set, the punch 630 moves downward together with the pressing base 626 to perform a punching operation for the folded sheet bundle SA as described above.

In step S308, the control unit drives the motor SM5 to move the deforming member 642 toward the sheet bundle (i.e., the right side in the drawing). Namely, the deforming member 642 moves from the standby position to a deforming position. Accordingly, the deforming member 642 presses the folded spinal portion St (i.e., a protruded portion) of the folded sheet bundle SA along the width direction of the folded spinal portion St. More specifically, the deforming member 642 moves while deforming the folded spinal portion St.

In step S309, the control unit determines whether the deforming member 642 has reached the deforming position where the deforming member 642 collides with the upper and lower pressing plates 627 and 628. If it is determined that the deforming member 642 has reached the deforming position (YES in step S309), then in step S310, the control unit deactivates the motor SM5 to stop the deforming member 642. The pressing force of the upper and lower pressing plates 627 and 628 can be set by the deformion spring 629 that gives a sufficient force for firmly holding the folded sheet bundle SA even when the deforming operation is performed.

Figure 13:
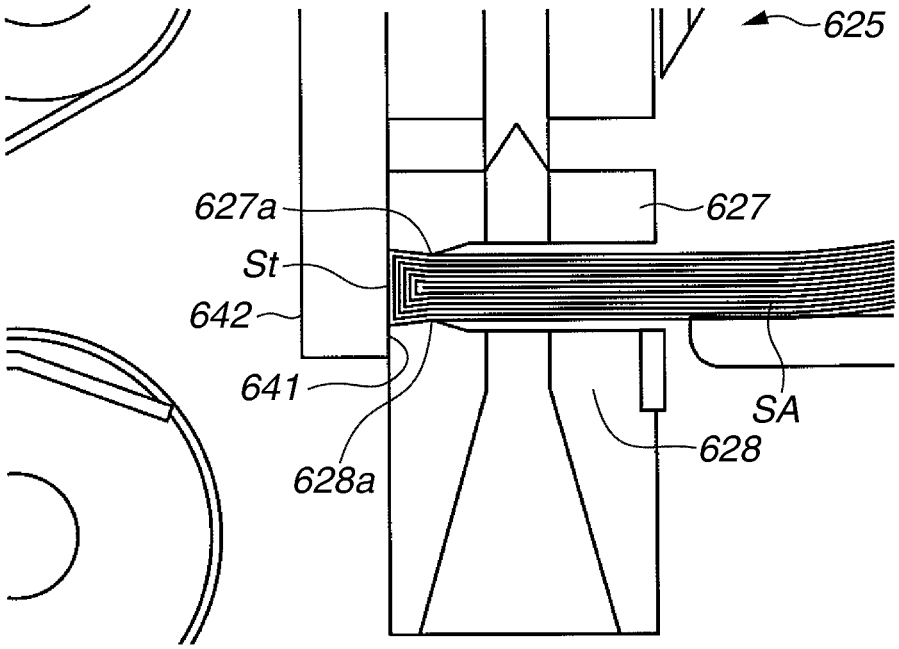
FIG. 13 illustrates a state of a folded spinal portion of a folded sheet bundle that has been subjected to the deforming processing.

In this manner, if the deforming member 642 moves while deforming the folded spinal portion St of the folded sheet bundle SA, the folded spinal portion St (i.e., a protruded portion in a curved shape) can be smoothed into a flat surface along the deforming surface 641 as illustrated in FIG. 13. The deforming amount of the folded spinal portion St is substantially equal to the above-described separation amount L.

In the present exemplary embodiment, the upper and lower pressing plates 627 and 628 have ridges 627*a* and 628*a* formed at their front ends. The ridges 627*a* and 628*a* are effective to deform the spinal portion St of the folded sheet bundle SA to form a substantially square edgein cross section. The deformation occurs on the downstream side of the ridges 627*a* and 628*a* in the conveyance direction. The bundle SA does not move and its shape does not deform on the upstream side of the ridges 627*a* and 628*a* in the conveyance direction. According to the above-described configuration, not only the front/back covers but also the bulk of inner sheets can be subjected to the deformation into a substantially squareedge.

Next, in step S311, the control unit drives the motor SM5 in the reverse direction to remove the deforming member 642 (more specifically, the deforming surface 641) from the folded spinal portion. The deforming member 642 moves to a retreat position illustrated in FIGS. 12A and 12B. In step S312, the control unit determines whether the deforming member 642 has reached the retreat position. If it is determined that the deforming member 642 has reached the retreat position (YES in step S312), then in step S313, the control unit deactivates the motor SM5 to stop the deforming member 642.

In step S314, the control unit drives the motor SM4 in the reverse direction to move the pressing base 626 to the upper position so that the folded sheet bundle SA can be released from the upper pressing plate 627. The control unit further drives the motor SM6 in the reverse direction to move the deforming unit 640 to the upper position. In step S315, the control unit determines whether the pressing base 626 and the deforming unit 640 have reached their upper positions. If it is determined that the pressing base 626 and the deforming unit 640 have reached their upper positions (YES in step S315), then in step S316, the control unit deactivates the motors SM4 and SM6 to hold the pressing base 626 and the deforming unit 640 at their upper positions.

Figure 14:
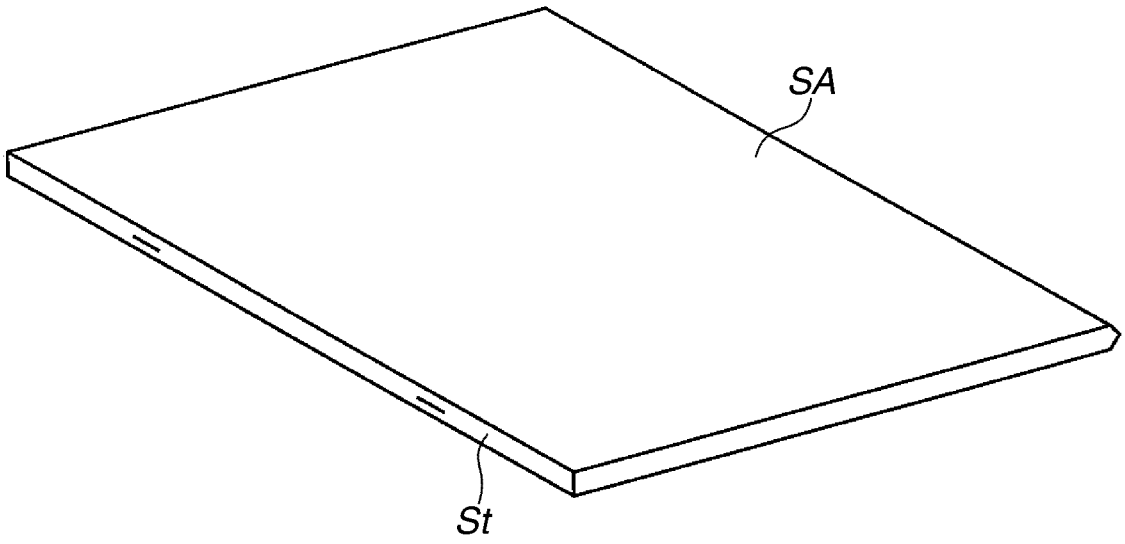
FIG. 14 is a perspective view illustrating a folded sheet bundle discharged after it is subjected to the above-described deforming processing.

In step S317, the control unit drives the lower conveyance belt 611, the conveyance claws 613, and the upper and lower conveyance belts 661 and 662 to restart conveying the folded sheet bundle SA. Thus, the folded sheet bundle SA can be conveyed to the downstream side in the conveyance direction. FIG. 14 is a perspective view illustrating a folded sheet bundle having been subjected to the deforming processing and discharged to the conveyor tray 670.

The above-described deforming processing uses a flat surface (i.e., the deforming surface 641 of the deforming member 642) to press a folded spinal portion. Therefore, the stress is uniformly applied to the folded spinal portion without causing any curl, scratch, or tear. When the folded spinal portion is deformed, the deforming force can be uniformly applied to the folded spinal portion in the thickness direction. Therefore, no shear stress acts between sheets. No breakage of a sheet occurs from a stapled portion.

A deforming amount required to deform all the sheets constituting a folded sheet bundle into a square shape increases according to the thickness of the folded sheet bundle. In other words, it is necessary to increase (i.e., change) the deforming amount by the deforming member 642, i.e., the separation amount L between the deforming surface 641 and the upper and lower pressing plates 627 and 628, in proportion to the number of sheets constituting the folded sheet bundle.

Therefore, in the present exemplary embodiment, the finisher control unit 501 controls the separation amount L according to a thickness of each folded sheet bundle, which can be calculated by the CPU circuit unit 150 based on sheet thickness information and the number of sheets constituting the folded sheet bundle which are entered beforehand. With the above-described configuration, the present exemplary embodiment can set an appropriate deforming amount that accords with the thickness of a sheet bundle and can adequately perform deforming (i.e., smoothing) processing for deforming a folded spinal portion into a square shape.

A deforming time (i.e., pressing time) required to keep the shape of a folded spinal portion stably even after the deforming processing is completed increases according to the rigidity (or thickness) of the folded sheet bundle. Therefore, in the present exemplary embodiment, the control unit can increase the time required for pressing the deforming surface 641 against the upper and lower pressing plates 627 and 628 according to a calculated thickness of the sheet bundle. In this manner, the pressing time by the deforming member 642 can be increased in proportion to the number of sheets constituting a folded sheet bundle. Therefore, the present exemplary embodiment can firmly deform and smooth the folded spinal portion having a curved shape. In the present exemplary embodiment, the control unit can calculate the thickness of a sheet bundle based on input information. However, the saddle stitch booklet processing unit 600 may include a bundle thickness detection unit (e.g., a displacement sensor). The control unit may control the separation amount L based on thickness information obtained by the bundle thickness detection unit.

In the present exemplary embodiment, the deforming surface 641 serves as a surface not only for adjusting the position of the folded sheet bundle SA but also applying the deforming force. Therefore, the present exemplary embodiment can reduce differences in the separation amount (i.e., deforming amount) L. As a result, the present exemplary embodiment can reduce differences in the square shape of respective folded spinal portions of two or more folded sheet bundles that are deformed together. The present exemplary embodiment can stably process each folded sheet bundle into a desired shape.

Figure 15:
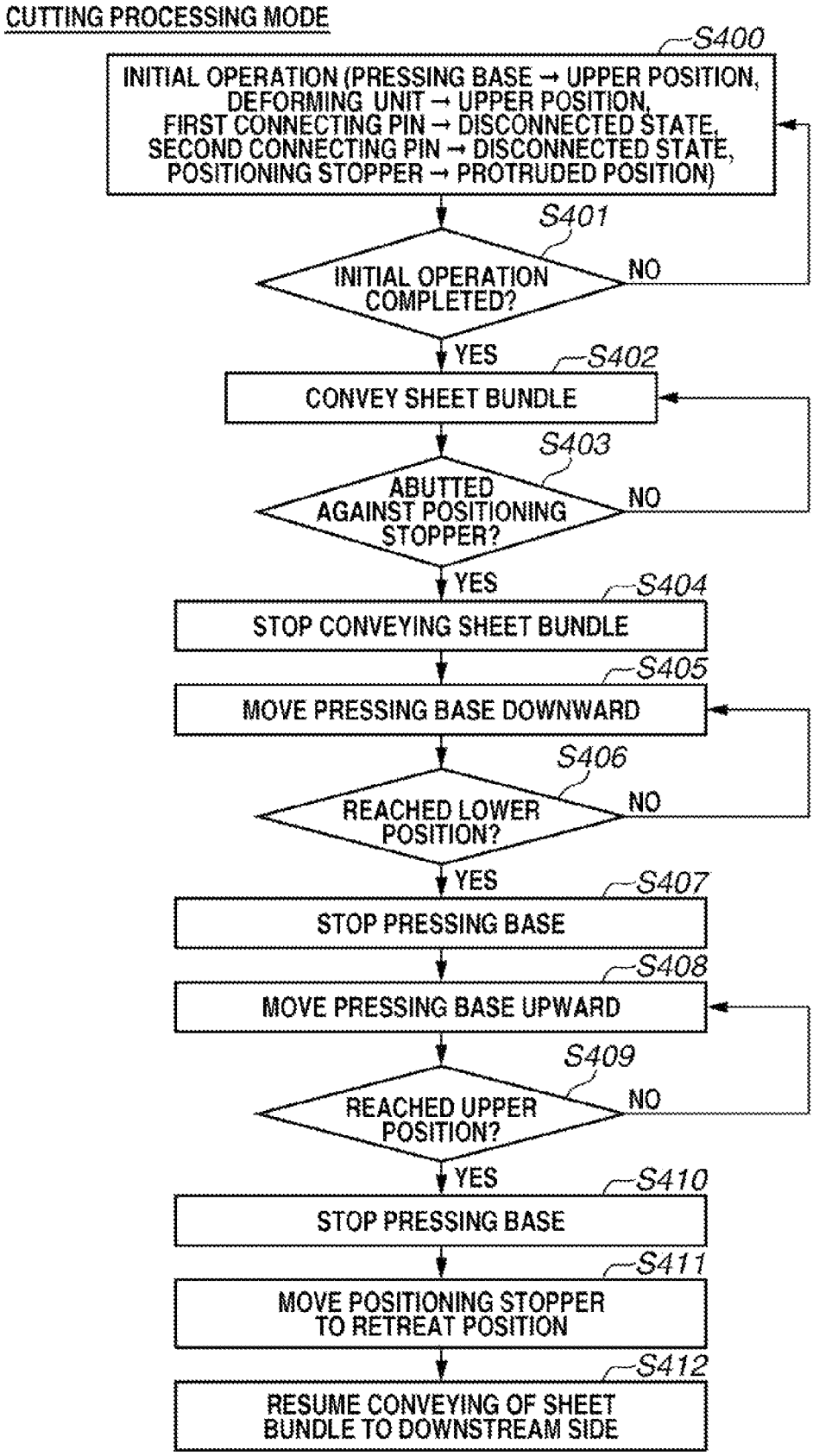
FIG. 15 is a flowchart illustrating cutting processing that can be performed as part of the booklet processing.

After the above-described punch processing and the deforming processing are selectively performed according to the setting modes, the control unit resumes the processing of the flowchart illustrated in FIG. 8. More specifically, in step S108, the control unit determines whether the cutting processing is instructed. If it is determined that the cutting processing is instructed (YES in step S108), i.e., if a cutting processing mode is selected, then in step S109, the control unit performs the cutting processing according to a flowchart illustrated in FIG. 15.

More specifically, in step S400, the control unit performs the following initial operation to start the cutting processing. The control unit moves the pressing base 626 to the upper position and moves the deforming unit 640 to the upper position before the folded sheet bundle SA is discharged to the booklet reception unit 610. The control unit brings the second connecting pin 631 into a disconnected state to disengage the punch 630 from the pressing base 626. The control unit brings the first connecting pin 623 into a disconnected state to disengage the upper cutting blade 621 from the pressing base 626. Moreover, the control unit causes the positioning stopper 663 of the bundle conveyance unit 660 to protrude from the conveyance path at a position corresponding to the size of the conveyed folded sheet bundle SA.

Figure 16:
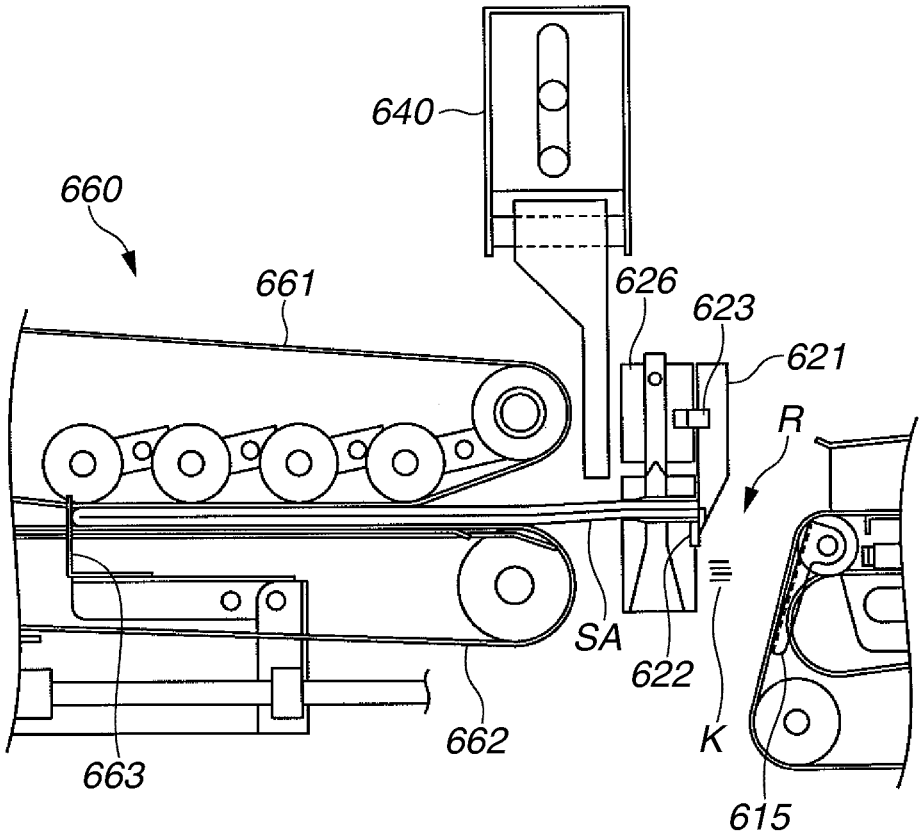
FIG. 16 illustrates cutting processing that can be performed by the booklet processing unit.

If it is determined that the above-described initial operation is completed (YES in step S401), then in step S402, the control unit drives the motors SM1 and SM2 to cause the lower conveyance belt 611 and the conveyance claws 613 to convey the folded sheet bundle SA. Then, in step S403, the control unit determines whether the folded spinal portion of the conveyed folded sheet bundle SA has collided against the positioning stopper 663 as illustrated in FIG. 16. If it is determined that the folded spinal portion of the conveyed folded sheet bundle SA abuts against the positioning stopper 663 (YES in step S403), then in step 404, the control unit stops conveying the folded sheet bundle SA.

In step S405, the control unit brings the first connecting pin 623 into a connected state to engage the upper cutting blade 621 with the pressing base 626. The control unit further drives the motor SM4 to move the pressing base 626 downward. If the pressing base 626 has reached the lower position (YES in step S406), then in step S407, the control unit deactivates the motor SM4 to stop the pressing base 626.

If the pressing base 626 moves downward, the upper cutting blade 621 moves together with the lowering pressing base 626. Then, the upper cutting blade 621 and the lower cutting blade 622 cooperatively cut a rear end (i.e., opened end) portion of the folded sheet bundle SA in the conveyance direction. In this manner, when the rear edge portion of the folded sheet bundle SA in the conveyance direction is cut, the shutter guide 615 rotates downward in synchronization with a movement of the upper cutting blade 621 by the cam (not illustrated) fixed to the upper cutting blade 621, as described above. Thus, the scrap K illustrated in FIG. 16 (i.e., the rear edge part of the folded sheet bundle SA having been cut) falls into a scrap box (not illustrated) positioned below the shutter guide 615.

In step S408, the control unit drives the motor SM4 in the reverse direction to move the pressing base 626 upward. If it is determined that the pressing base 626 has reached the upper position (YES in step S409), then in step S410, the control unit deactivates the motor SM4 to stop the pressing base 626 at the upper position. In step S411, the control unit moves the positioning stopper 663 to the retreat position below the conveyance path.

In step S412, the control unit drives the lower conveyance belt 611, the conveyance claws 613, and the upper and lower conveyance belts 661 and 662 to restart conveying the folded sheet bundle SA. Thus, the folded sheet bundle SA can be conveyed to the downstream side in the conveyance direction. Then, in step S110, the control unit discharges the folded sheet bundle SA to the conveyor tray 670. As described above, the apparatus according to the present exemplary embodiment can process a folded sheet bundle as requested by an operator.

Figure 17:
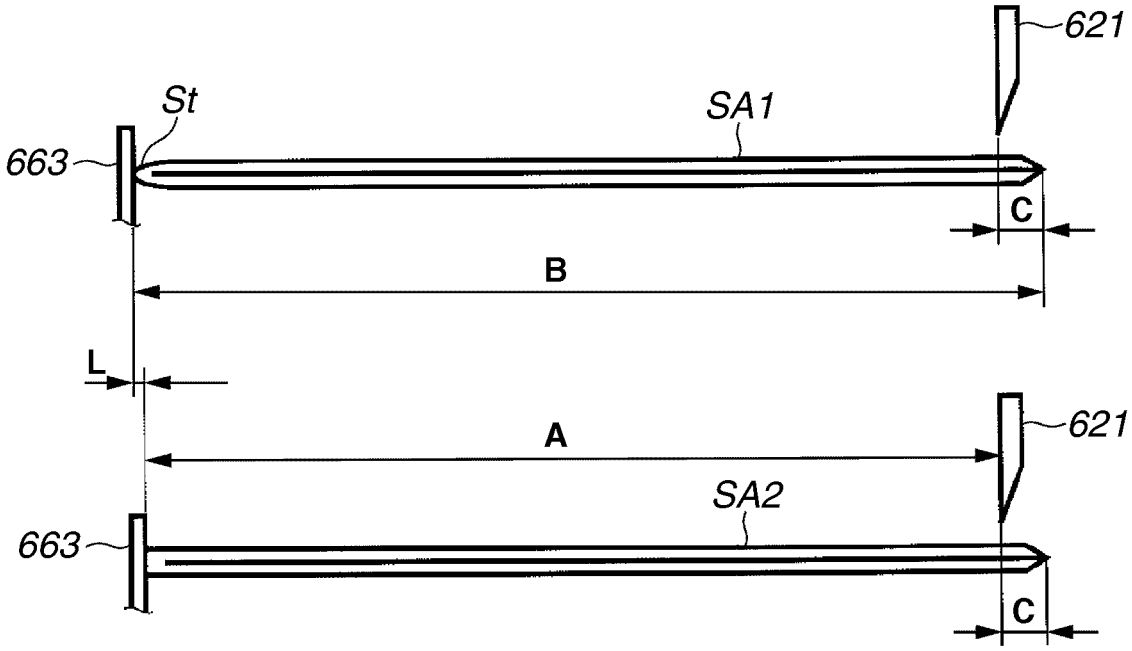
FIG. 17 illustrates a stop position of a folded sheet bundle in the cutting processing, which is differently set according to the presence of a deforming processing setting.
Figure 18A:
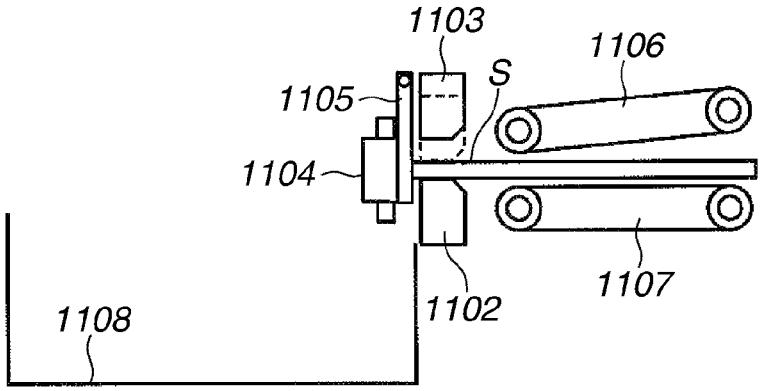
PRIOR ART FIG.18A
FIGS. 18A, 18B and 18C illustrate a configuration of a conventional sheet processing apparatus.
Figure 18B:
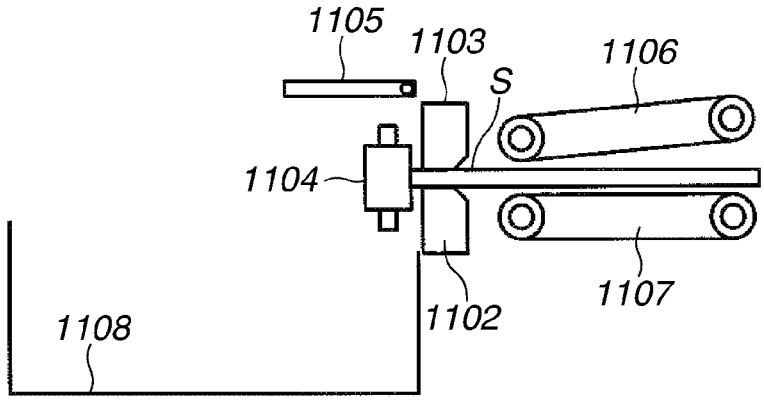
Figure 18C:
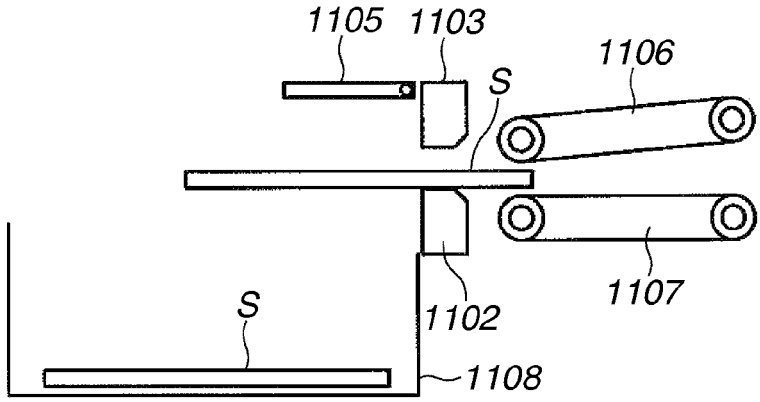
Figure 19A:
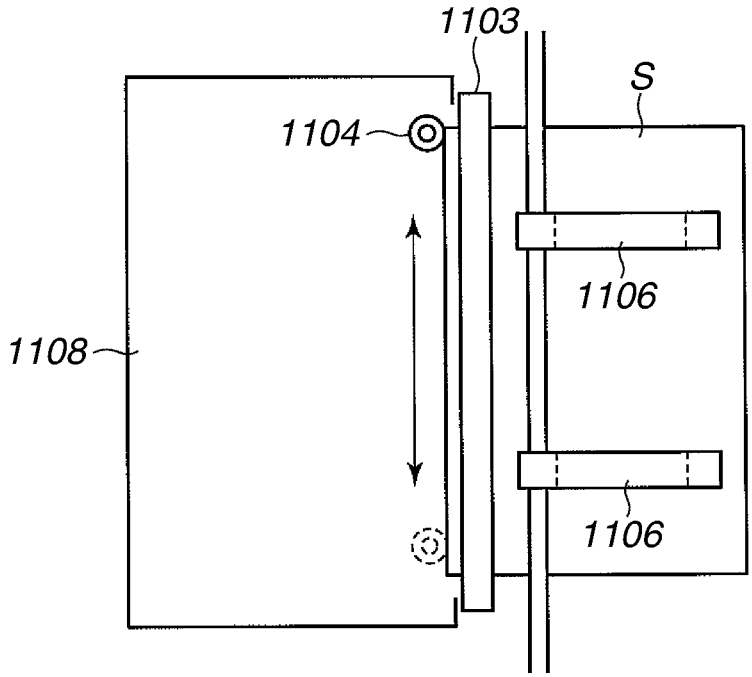
PRIOR ART FIG.19A
FIGS. 19A and 19B illustrate deforming processing applied to a folded spinal portion of a folded sheet bundle in the conventional sheet processing apparatus.
Figure 19B:
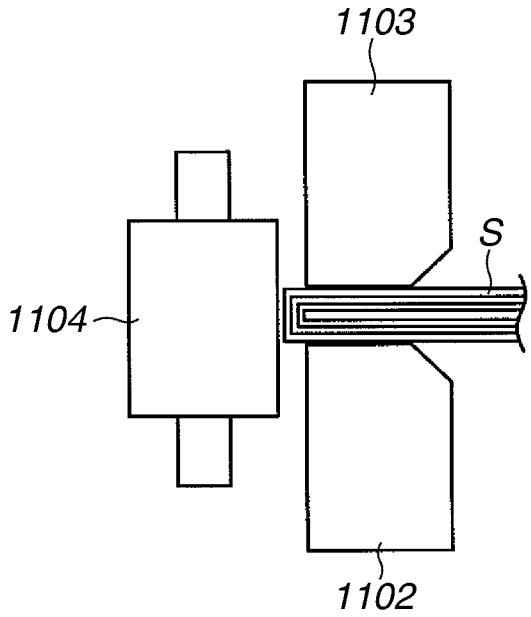
Figure 20:
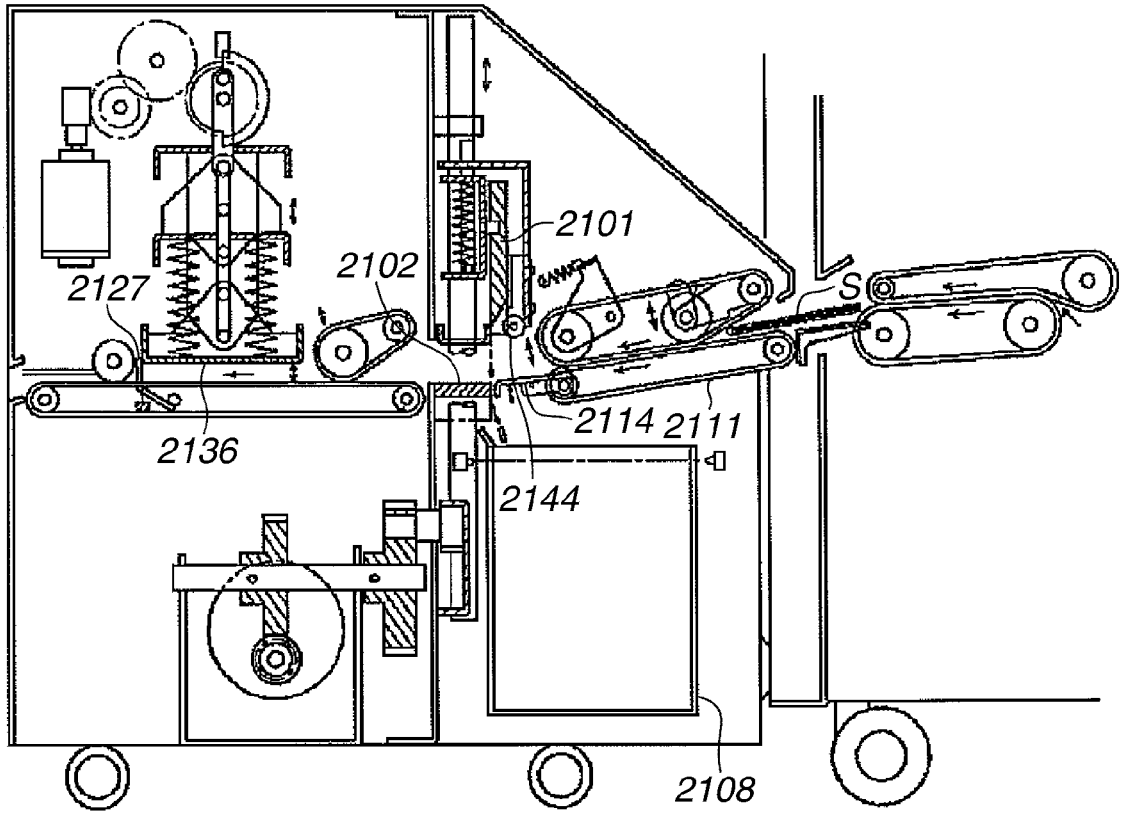
PRIOR ART FIG.20
FIG. 20 illustrates a configuration of a conventional sheet processing apparatus.
Figure 21:
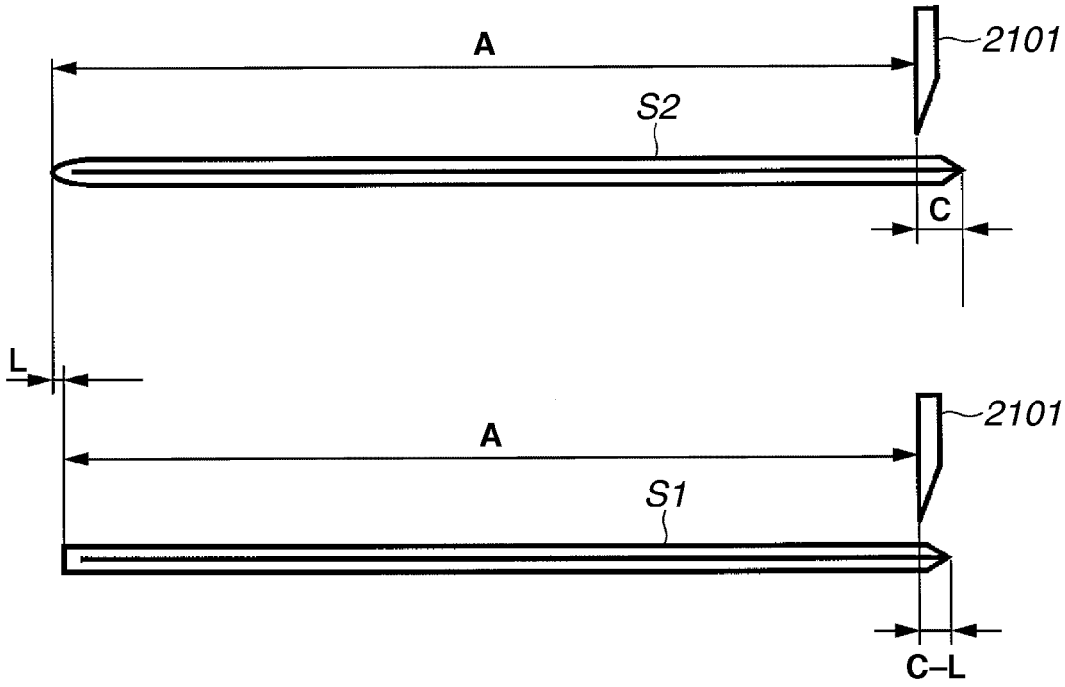
PRIOR ART FIG.21
FIG. 21 illustrates a difference in the cutting amount in the conventional sheet processing apparatus, which occurs due to the presence of a deforming processing setting.

In the present exemplary embodiment, an operation of the stopper moving motor SM8 is controlled to change the position of the positioning stopper 663 in the conveyance direction, in the cutting processing, according to the presence of a deforming processing setting applied to the folded sheet bundle SA having the same bundle thickness. As illustrated in FIG. 17, in a case where a folded sheet bundle SA1 not subjected to the deforming processing is stopped, the control unit sets the position of the positioning stopper 663 to be shifted to the downstream side in the conveyance direction by a deforming amount L compared to a position of the positioning stopper 663 in a case where a folded sheet bundle SA2 has been subjected to deforming processing is stopped.

When the stop position of the folded sheet bundle SA1 (i.e., the bundle not subjected to the deforming processing) is shifted to the downstream side in the conveyance direction by the deforming amount L, an edge portion of the bundle can be constantly cut by a same length (edge portion cutting amount) C, irrespective of the presence of a deforming processing setting, in the cutting processing.

With the position control of the positioning stopper 663 that abuts against the folded sheet bundle SA, the cutting processing can be performed according to an edge portion cutting amount determined by an operator, irrespective of the presence of a deforming processing setting. The edge portion cutting amount is a value obtained by subtracting a length of the folded sheet bundle in the sheet conveyance direction from a distance from the folded spinal portion of the folded sheet bundle to a cutting position. It is desired to determine the edge portion cutting amount so that the edge portion to be cut off is spaced from an image forming area of each sheet constituting the folded sheet bundle after a convex shape of the folded spinal portion is deformed into a flat shape. In the present exemplary embodiment, an operator can operate the operation unit 1 (i.e., the setting unit) to finely adjust the cutting amount while confirming an actually finished product. The above-described saddle stitch booklet processing modes can be freely combined.

In the present exemplary embodiment, the setting position of the positioning stopper 663 is changeable. Alternatively, it may be useful to fix the stop position of the folded sheet bundle and move the upper and lower cutting blades 621 and 622, which cooperatively constitute the cutting unit, to adjust the cutting length from a folded spinal portion of a folded sheet bundle to a cutting position by the deforming amount L according to the execution of the deforming processing.

Alternatively it is also possible to move both the positioning stopper 663 and the cutting unit to adjust the cutting length from a folded spinal portion of a folded sheet bundle to a cutting position. The edge portion cutting amount can thus be kept constant by setting a difference equivalent to the deforming amount L in a cutting length from a folded spinal portion of a folded sheet bundle to a position to be cut by the upper cutting blade 621 by the deforming amount L in the conveyance direction depending on whether or not a deforming processing setting is implemented. Therefore, a convex shape formed at an opened end portion of a folded sheet bundle can be cut off without influencing the image forming area of the sheet bundle.

As described above, in a case where the folded sheet bundle SA1 not subjected to the deforming processing is cut, the position of the positioning stopper 663 is shifted to the downstream side in the conveyance direction by the deforming amount if the bundle thickness of the sheet bundle is constant. Thus, the cutting processing can be performed according to an edge portion cutting amount determined by an operator, irrespective of the presence of a deforming processing setting. As a result, an operator is not required to perform cutting amount adjustment according to the mode. A folded sheet bundle having been cut into a desired length can be obtained.

To control the position of the positioning stopper 663 that stops the folded sheet bundle SA2 which has been subjected to the deforming processing, the CPU circuit unit 150 controls an output pulse of the stopper moving motor SM8 based on a signal of a home position sensor, a sheet bundle size, a set cutting amount, and the deforming amount L. The CPU circuit unit 150 performs the control so as to satisfy a relationship A=B-C-L, wherein "A" represents a distance from the positioning stopper 663 to the upper and lower cutting blades 621 and 622 when the folded sheet bundle SA2 is cut, "B" represents the length of the folded sheet bundle SA1 in the conveyance direction, "C" represents the edge portion cutting amount, and "L" represents the deforming amount by the deforming unit 640. Namely, to secure the constant edge portion cutting amount C, the distance "A" from the folded spinal portion of the folded sheet bundle SA2 having been subjected to the deforming processing to the cutting position is set to be shorter than the distance B from the folded spinal portion of the folded sheet bundle SA1 not subjected to the deforming processing to the cutting position.

In the present exemplary embodiment, the deforming amount L can be increased according to the thickness of the folded sheet bundle SA2. The thickness of the folded sheet bundle SA2 can be calculated by the CPU circuit unit 150 (see FIG. 7) based on information about the number of sheets constituting the folded sheet bundle SA2 and preferably also on sheet thickness information. When the CPU circuit unit 150 (i.e., the thickness calculation unit) either increases the deforming amount L in accordance with an increase in thickness of the folded sheet bundle SA2 calculated based on at least the number of sheets in this manner or decreases the deforming amount L in accordance with a decrease in thickness of the folded sheet bundle SA2, the cutting processing can be accurately performed according to a cutting amount set by an operator as set out below. In short, to secure the constant edge portion cutting amount C, the present exemplary embodiment decreases the distance A (i.e., the length from the folded spinal portion of the folded sheet bundle SA2 having been subjected to the deforming processing to the cutting position) in accordance with an increase in the thickness of the folded sheet bundle SA2 and increases distance A in accordance with a decrease in the thickness of the folded sheet bundle SA2.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application Nos. 2008-180986 filed Jul. 11, 2008 and 2009-147448 filed Jun. 22, 2009 which are hereby incorporated by reference herein in their entirety.

What is claimed is:

1. A sheet processing apparatus that processes a folded sheet bundle made of a plurality of folded sheets, comprising:

a deforming unit configured to perform deforming processing by deforming a folded spinal portion of the folded sheet bundle into a square shape;

a cutting unit configured to cut an edge portion, opposite to the folded spinal portion, of the folded sheet bundle;

a stopper configured to abut against the folded spinal portion of the folded sheet bundle to perform positioning for the folded sheet bundle to be cut by the cutting unit;

a moving unit configured to move the stopper; and a control unit configured to control the moving unit so that a distance between the stopper and the cutting unit, when the deforming processing is set, is shorter by a predetermined distance than that when the deforming processing is not set, wherein the control unit controls the moving unit so that when the deforming processing is set, a position of the stopper is set closer to the cutting unit by the predetermined distance corresponding to a reduction in length of the folded sheet bundle deformed by the deforming unit.

2. The sheet processing apparatus according to claim 1, wherein the control unit controls the deforming unit so that the predetermined distance is increased according to an increase of a thickness of the sheet bundle.

3. The sheet processing apparatus according to claim 1, wherein the control unit controls a position of the folded sheet bundle in relation to the cutting unit so that a distance from the folded spinal portion of the folded sheet bundle subjected to the deforming processing to a position to be cut by the cutting unit increases as a thickness of the folded sheet bundle decreases.

4. An image forming apparatus comprising:

an image forming unit configured to form an image on a sheet; and a sheet processing apparatus configured to process a folded sheet bundle made of a plurality of sheets on which images are formed, the sheet processing apparatus includes:

a deforming unit configured to perform deforming processing by deforming a folded spinal portion of the folded sheet bundle into a square shape;

a cutting unit configured to cut an edge portion, opposite to the folded spinal portion, of the folded sheet bundle;

a stopper configured to abut against the folded spinal portion of the folded sheet bundle to perform positioning for the folded sheet bundle to be cut by the cutting unit;

a moving unit configured to move the stopper; and a control unit configured to control the moving unit so that a distance between the stopper and the cutting unit, when the deforming processing is set, is shorter by a predetermined distance than that when the deforming processing is not set, wherein the control unit controls the moving unit so that when the deforming processing is set, a position of the stopper is set closer to the cutting unit by the predetermined distance corresponding to a reduction in length of the folded sheet bundle deformed by the deforming unit.

5. The image forming apparatus according to claim 4, further comprising:

a setting unit configured to set whether or not the deforming processing is to be applied to the folded spinal portion of a folded sheet bundle, wherein the position of the stopper is changed depending on the setting of the setting unit.

6. The image forming apparatus according to claim 4, further comprising:

a thickness calculation unit configured to calculate a thickness of the folded sheet bundle based on information about the number of sheets constituting the sheet bundle.

7. The image forming apparatus according to claim 6, wherein the control unit controls the deforming unit so that the distance is increased according to an increase of a thickness of the sheet bundle.

8. The image forming apparatus according to claim 4, wherein the control unit controls the position of the folded sheet bundle in relation to the cutting unit so that the distance from the folded spinal portion of the folded sheet bundle subjected to the deforming processing to a position to be cut by the cutting unit increases as a thickness of the folded sheet bundle decreases.

9. An image forming apparatus comprising:

an image forming unit configured to form an image on a sheet;

a sheet processing apparatus configured to process a folded sheet bundle made of a plurality of folded sheets on which images are formed; and a control unit configured to control the sheet processing apparatus, the sheet processing apparatus includes:

a deforming unit configured to perform deforming processing by deforming a folded spinal portion of the folded sheet bundle into a square shape;

a cutting unit configured to cut an edge portion, opposite to the folded spinal portion, of the folded sheet bundle;

a stopper configured to abut against the folded spinal portion of the folded sheet bundle to perform positioning for the folded sheet bundle to be cut by the cutting unit; and a moving unit configured to move the stopper;

wherein the control unit controls the moving unit so that a distance between the stopper and the cutting unit, when the deforming processing is set, is shorter than that when the deforming processing is not set, and wherein the control unit controls the moving unit so that when the deforming processing is set, a position of the stopper is set closer to the cutting unit by the predetermined distance corresponding to a reduction in length of the folded sheet bundle deformed by the deforming unit.

10. The image forming apparatus according to claim 9, further comprising:

a setting unit configured to set whether or not the deforming processing is to be applied to the folded spinal portion of a folded sheet bundle, wherein the position of the stopper is changed depending on the setting of the setting unit.

11. The image forming apparatus according to claim 10, wherein the control unit controls the deforming unit so that the distance is increased according to an increase of a thickness of the sheet bundle.

12. The image forming apparatus according to claim 9, wherein the control unit controls a position of the folded sheet bundle in relation to the cutting unit so that a distance from the folded spinal portion of the folded sheet bundle subjected to the deforming processing to a position to be cut by the cutting unit increases as a thickness of the folded sheet bundle decreases.

* * * * *